US007364247B2

(12) United States Patent
Iwao et al.

(10) Patent No.: US 7,364,247 B2
(45) Date of Patent: Apr. 29, 2008

(54) CONTROLLER OF INK JET HEAD, CONTROL METHOD OF INK JET HEAD, AND INK JET RECORD APPARATUS

(75) Inventors: Naoto Iwao, Nagoya (JP); Atsuo Sakaida, Gifu (JP); Ayumu Matsumoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 314 days.

(21) Appl. No.: 11/089,028

(22) Filed: Mar. 25, 2005

(65) Prior Publication Data

US 2005/0219290 A1 Oct. 6, 2005

(30) Foreign Application Priority Data

Mar. 25, 2004 (JP) ..... P2004-090255

(51) Int. Cl.
*B41J 29/38* (2006.01)

(52) U.S. Cl. ..... 347/10; 347/11

(58) Field of Classification Search ..... 347/5, 347/10, 11

See application file for complete search history.

(56) References Cited

U.S. PATENT DOCUMENTS

| | | | | |
|---|---|---|---|---|
| 4,575,730 | A | 3/1986 | Logan et al. | |
| 6,193,346 | B1 * | 2/2001 | Nakano | 347/12 |
| 6,332,672 | B1 * | 12/2001 | Yazaki et al. | 347/70 |
| 6,419,339 | B2 | 7/2002 | Takahashi | |
| 6,830,305 | B1 * | 12/2004 | Takizawa | 347/10 |
| 7,293,851 | B2 * | 11/2007 | Nakayama | 347/10 |
| 2004/0130584 | A1 * | 7/2004 | Kobayashi et al. | 347/11 |
| 2005/0088468 | A1 * | 4/2005 | Clark | 347/11 |
| 2005/0116974 | A1 * | 6/2005 | Suzuki | 347/10 |
| 2005/0231543 | A1 * | 10/2005 | Hosono | 347/15 |

FOREIGN PATENT DOCUMENTS

| | | |
|---|---|---|
| EP | 1 354 704 | 10/2003 |
| EP | 1 428 665 | 6/2004 |
| JP | 2001-277507 | 10/2001 |
| JP | 2003-1826 | 1/2003 |

OTHER PUBLICATIONS

European Search Report for Application No. 05 00 6593, completed Jun. 21, 2005.

* cited by examiner

*Primary Examiner*—Stephen Meier
*Assistant Examiner*—Sarah Al-Hashimi
(74) *Attorney, Agent, or Firm*—Banner & Witcoff, LTD

(57) ABSTRACT

A controller of an ink jet head includes a waveform information storage section for storing waveform patterns concerning a plurality of types of drive signals capable of making positions of dots formed on print paper by ejecting ink from nozzles different from each other with respect to a predetermined direction orthogonal to a relative moving direction between the print paper and the ink jet head. The controller further includes a waveform selection section for selecting one drive signal from among the plurality of drive signals stored in the waveform information storage section so that the same type of drive signal is not selected n or more successive times (where n is a natural number of two or more) for each nozzle.

22 Claims, 16 Drawing Sheets

CONTROLLER OF INK JET HEAD, CONTROL METHOD OF INK JET HEAD, AND INK JET RECORD APPARATUS

BACKGROUND OF THE INVENTION

1. Field of the Invention

This invention relates to a controller of an ink jet head for ejecting ink droplets to a record medium for printing, a control method of an ink jet head, and an ink jet record apparatus.

2. Description of the Related Art

An ink jet printer causes ink droplets ejected from an ink jet head to hit printer paper that is moving relative to the ink jet head, thereby forming any desired image on the print paper. Known as such an ink jet head is a head including a plurality of nozzles for ejecting ink droplets, a plurality of pressure chambers communicating with the nozzles, and a plurality of actuators placed so as to correspond to the pressure chambers. When an actuator is driven, the volume of the pressure chamber corresponding to the actuator decreases and ink as much as the decreased volume is ejected as an ink droplet from the nozzle.

Ink is held by capillarity in an ink flow passage including a nozzle and a pressure chamber, and an ink meniscus is formed in the nozzle. When an ink droplet is ejected, pressure produced when the actuator changes the volume of the pressure chamber remains in the ink flow passage. Thus, the ink meniscus in the nozzle vibrates accordingly. The vibration frequency of the meniscus depends on pressure wave propagation time T in the ink flow passage. The propagation time T is determined by length L of the ink flow passage. That is, letting the pressure wave propagation velocity be a, the propagation time T is determined as $T=L/a$.

The meniscus shape may be disordered because of the affect of the shape of the ink flowpassage, etc., and the effect of the remaining pressure in the ink flow passage produced by ejecting the ink droplet, etc., resulting in worsening the hit accuracy of the ink droplet. Then, JP-A-2001-277507 (FIG. 2) discloses an art of appropriately selecting the ejection timing at which the remaining vibration can be restricted in response to the ejection situation of ink droplets and ejecting an ink droplet in a predetermined cycle, thereby enhancing the hit accuracy of the ink droplets. Accordingly, the ink droplet ejected from the nozzle can be always caused to hit a constant position regardless of the ejection situation of the ink droplets.

SUMMARY OF THE INVENTION

According to the art described above, the ejected ink droplet always hits the constant position and thus no ink droplet hits the area opposed to the space between the nozzles, of print paper and an undesired blank area exists in a print result. In the ink jet head, the volume of the ejected ink droplet depends on the opening area of the nozzle and thus the number of ink droplets to be ejected is increased or decreased for providing gradation representation. For low-density printing, the print density is low and thus an undesired blank area is hard to be visually recognized in the print result. However, for high-density printing, ink droplets are ejected onto the print paper at high density only along the direction relative to the moving direction of the print paper and thus an undesired blank area is recognized in the print result, as a white stripe (white patch).

The invention provides a controller of an ink jet head, a control method of an ink jet head, and an ink jet record apparatus, wherein occurrence of a white stripe can be restricted in a print result for high-density printing.

According to one aspect of the invention, there is provided a controller of an ink jet head for ejecting ink droplets from a plurality of nozzles. The controller includes a waveform information storage member for storing waveform information concerning a plurality of types of drive signals capable of making positions of dots to be formed on a print medium by ejecting ink from the nozzles different from each other with respect to a predetermined direction orthogonal to a relative moving direction between the print medium and the ink jet head; and a selection member for selecting one drive signal from among the plurality of types of drive signals relating to the waveform information stored in the waveform information storage member so that a same type of drive signal is not selected n or more successive times (where n is a natural number of 2 or more) for each nozzle.

According to another aspect of the invention, there is provided a control method of an ink jet head for ejecting ink droplets from a plurality of nozzles, wherein one drive signal is selected from among a plurality of types of drive signals capable of making positions of dots to be formed on a print medium by ejecting ink from the nozzles different from each other with respect to a predetermined direction orthogonal to a relative moving direction between the print medium and the inkjet head so that the same type of drive signal is not selected n or more successive times (where n is a natural number of 2 or more) for each nozzle.

According to the above aspects, dots which are the same in the position in the direction orthogonal to the relative move direction of the print medium, are not successive along the relative move direction, so that occurrence of a white stripe can be suppressed if high-density print is executed.

DESCRIPTION OF THE PREFERRED EMBODIMENTS

Referring now to the accompanying drawings, there is shown an exemplary embodiment according to the invention.

Figure 1:
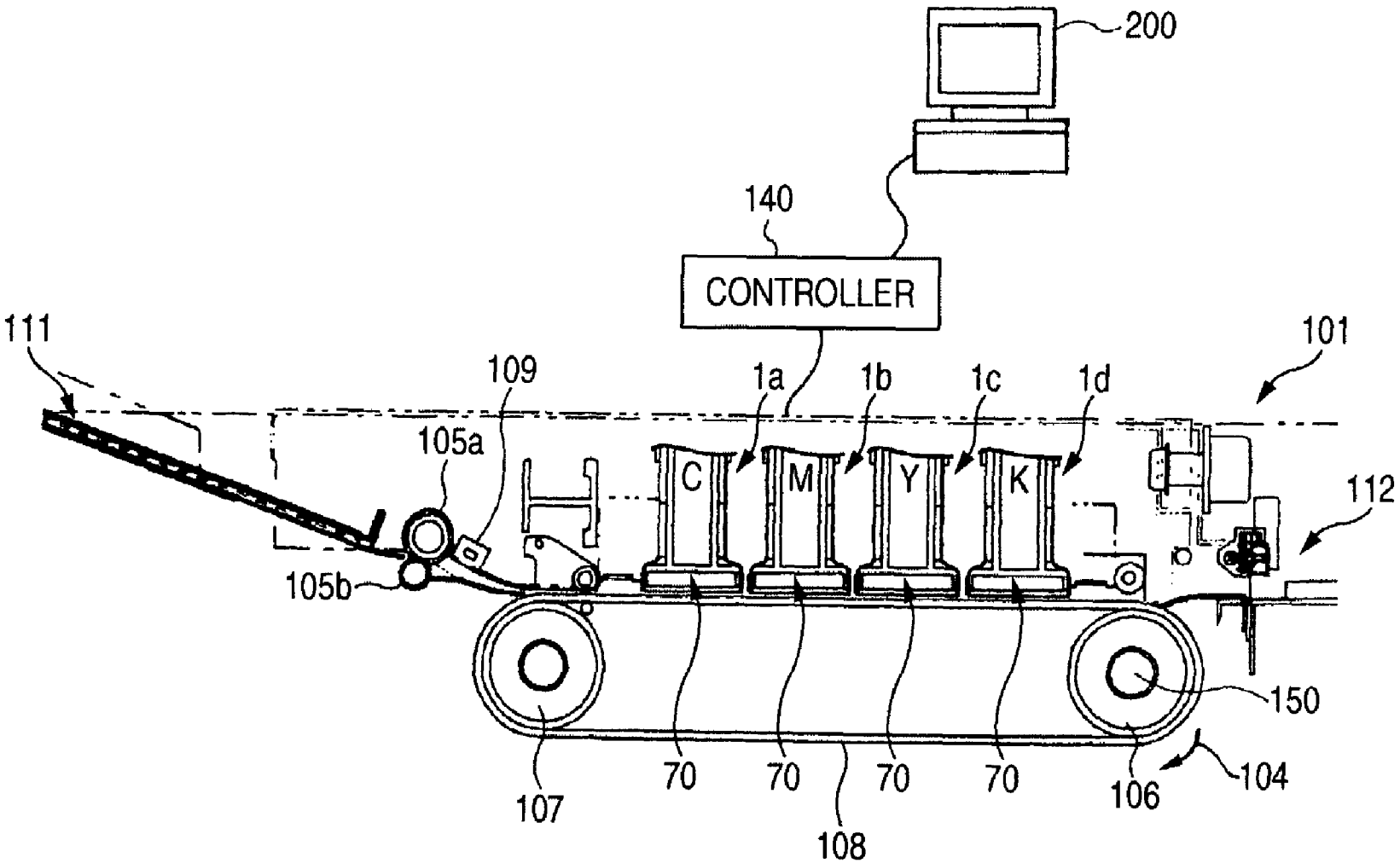
FIG. 1 is a schematic drawing of an ink jet printer according to an embodiment of the invention.

FIG. 1 is a schematic drawing of an ink jet printer in the embodiment. An ink jet printer 101 shown in FIG. 1 is a color ink jet printer having four ink jet heads 1*a* to 1*d*. The ink jet printer 101 is provided with a paper feed section 111 on the left of the figure and a paper ejection section 112 on the right of the figure. The ink jet printer 101 includes a controller 140 for controlling the ink jet printer 101. The user can operate the inkjet printer 101 through driver software running on a PC (personal computer) 200 connected to the controller 140.

A paper transport passage for transporting print paper from the paper feed section 111 to the paper ejection section 112 is formed in the inkjet printer 101. A direction extending from the paper feed section 111 to the paper ejection section 112 (a direction indicated by an arrow in FIG. 4) refers to a paper transport direction. A pair of feed rollers 105*a* and 105*b* for pinching and transporting print paper of a print medium and a sheet sensor 109 are placed immediately downstream from the paper feed section 111 in the paper transport direction. The print paper is transported from the left to the right in the figure by the pair of feed rollers 105*a* and 105*b*. During the transportation, the sheet sensor 109 recognizes the type of the print paper, and outputs the recognition result to the controller 140. Placed in the mid-section of the paper transport passage are two belt rollers 106 and 107, an endless conveyor belt 108 wound around both the rollers 106 and 107, and a transport motor 150 for driving the belt rollers 106 and 107. Silicone treatment is applied to the outer peripheral surface of the conveyor belt 108, namely, the transport face so that print paper transported by the pair of feed rollers 105*a* and 105*b* can be transferred downstream in the paper transporting direction (to the right in the figure) by rotating one belt roller 106 clockwise in the figure (in the direction of an arrow 104) while the printer paper is retained on the transport face of the conveyor belt 108 by its adhesive strength.

Each of the ink jet heads 1*a* to 1*d* of four line heads has a head main body 70 at the bottom. The head main bodies 70 each have a rectangular shape in cross section. The inkjet heads 1*a* to 1*d* are aligned to each other so that longer sides of their head main bodies 70 extends in a direction perpendicular to the paper transport direction (in a direction perpendicular to the surface of the drawing sheet of FIG. 1). This is, the ink jet printer 101 is a line printer. The bottom faces of the four head main bodies 70 are opposed to the paper transport passage and are provided with each a nozzle plate formed with a plurality of nozzles 8 each having a minute diameter. The bottom faces of the nozzle plates provide ink ejection faces and ink ejected from the nozzle 8 travels in the direction substantially orthogonal to the ink ejection face. Cyan (C) ink is ejected from the head main body 70 of the ink jet head 1*a*; magenta (M) ink is ejected from the head main body 70 of the ink jet head 1*b*; yellow (Y) ink is ejected from the head main body 70 of the ink jet head 1*c*; and black (K) ink is ejected from the head main body 70 of the ink jet head 1*d*.

Each of the head main bodies 70 is placed so that a small gap is formed between the bottom faces of the head main bodies 70 and the transport face of the conveyor belt 108, and the gap provides paper transport passage therebetween. In the composition, when print paper transported on the conveyor belt 108 passes through just under the four head main bodies 70 in order, color ink droplets are jet from the nozzles to the top face of the print paper, namely, the print face, whereby any desired color image can be formed on the print paper.

Figure 2:
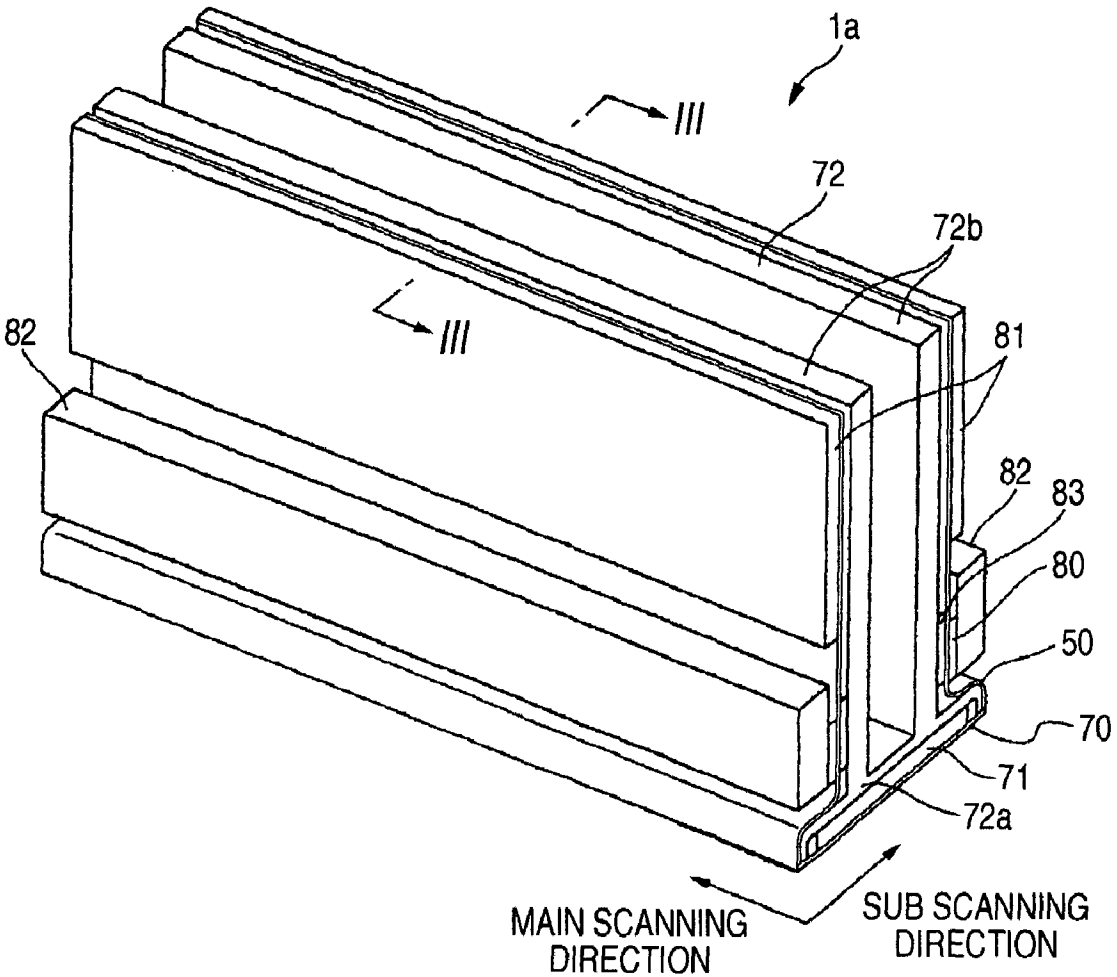
FIG. 2 is a perspective view of an ink jet head shown in FIG. 1.
Figure 3:
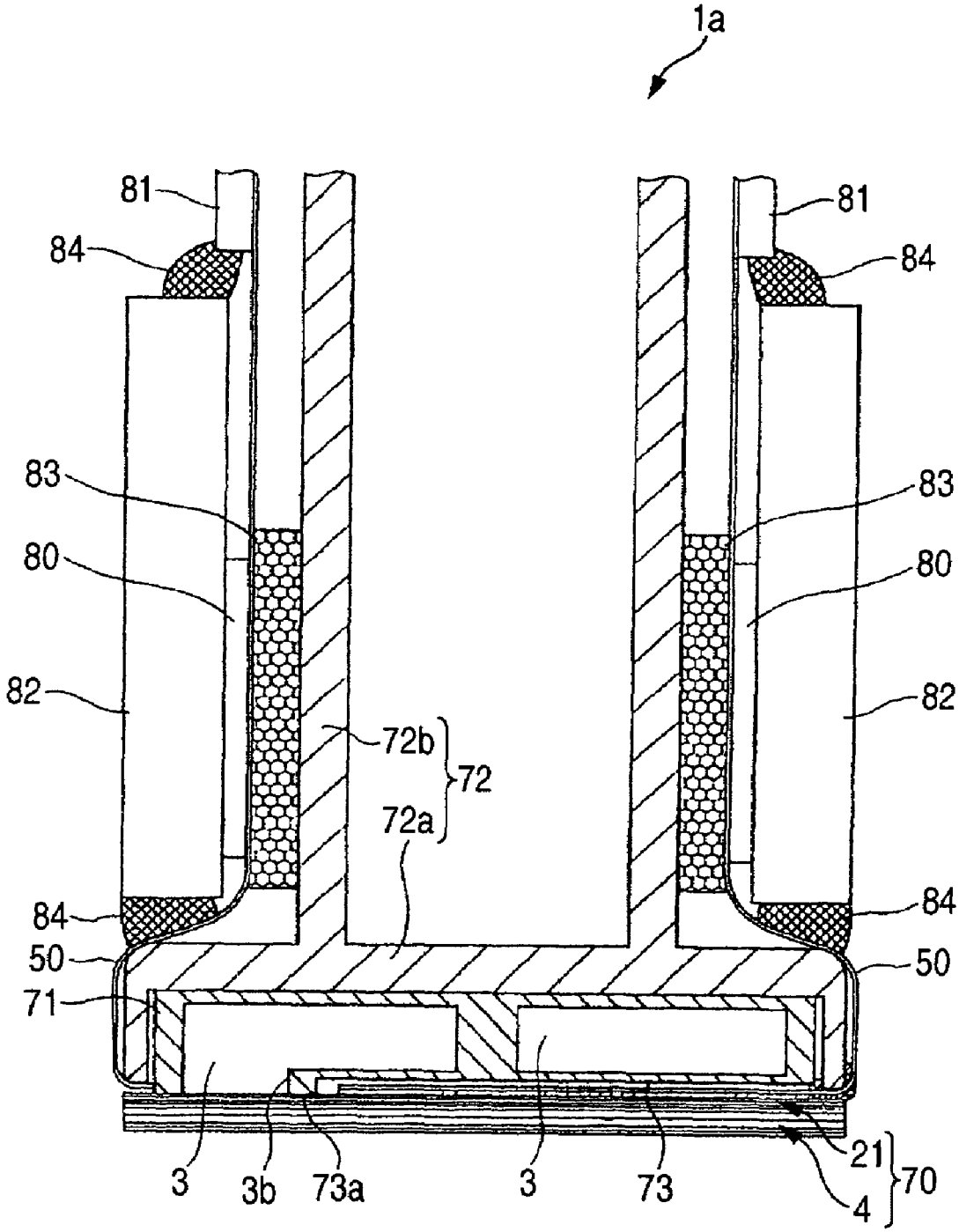
FIG. 3 is a sectional view of the ink jet head taken on line III-III in FIG. 2.

Next, the ink jet heads 1*a* to 1*d* will be discussed in detail. Although the ink jet heads 1*a* to 1*d* eject ink of different colors, the ink jet heads 1*a* to 1*d* are substantially identical in configuration and operation. Therefore only the ink jet head 1*a* will be discussed. FIG. 2 is an external perspective view of the ink jet head 1*a*. FIG. 3 is a sectional view taken on line III-III in FIG. 2. The ink jet head 1*a* includes the head main body 70, which has a rectangular shape in a plain view and whose surface extends in a main scanning direction for ejecting an ink droplet to print paper, and a base block 71, which is placed above the head main body 70 and formed with two ink reservoirs 3 of a flow passage of ink supplied to the head main body 70.

The head main body 70 includes a flowpassage unit 4 formed with ink flow passages, and a plurality of actuator units 21 bonded to the top of the flow passage unit 4. The flow passage unit 4 and the actuator units 21 are formed by which a plurality of thin plates are laminated one upon the other and are bonded to each other. A flexible printed wiring board (FPC: Flexible Printed Circuit) 50 of a power feed member is bonded to the top of each of the actuator units 21 and is drawn out to both sides of the inkjet head 1*a*. The base block 71 is made of a metal material, for example, stainless steel. Each ink reservoir 3 in the base block 71 is a hollow area having a substantially rectangular parallelepiped extending in a direction along the length direction of the base block 71.

The base block 71 has a lower face 73 and openings 3*b*. In the lower face, the vicinity of each opening 3*b* protrudes downward from the portions surrounding the openings 3*b*. The reference numeral 73*a* designates the vicinity portion. The base block 71 is in contact with the flow passage unit 4 only at the vicinity portions 73*a* of the openings 3*b* of the lower face 73. Thus, areas of the lower face 73 of the base block 71, other than the vicinity portions 73*a* of the openings 3*b* are separated from the head main body 70, and the actuator units 21 is disposed in the space created between the head main body 70 and the base block 71.

The base block 71 is bonded and fixed to the inside of a recess part formed in the lower face of a grip part 72*a* of a holder 72. The holder 72 includes the grip part 72*a* and a pair of projection parts 72*b* each shaped like a flat plate. The pair of projection parts 72*b* extends upward from the top face of the grip part 72*a* in the direction orthogonal to a direction that the top face of the grip portion 72*a* extends, at a predetermined distance from each other. The FPCs 50 bonded to the respective actuator units 21 are placed so as to extend along the surfaces of the projection parts 72*b* of the holder 72 while elastic members 83, such as sponges, are provided between the projection parts 72*b* and the FPCs. A driver 1C 80 is installed on each of the FPCs 50 placed on the surfaces of the projection parts 72*b* of the holder 72. The driver IC 80 drives the actuator unit 21. The FPCs 50 are electrically jointed to the respective driver IC 80 and the actuator units 21 by soldering so as to transmit drive signals output from the driver IC 80 to the actuator units 21 of the head main body 70.

A heat sink 82 having a substantially rectangular parallelepiped is placed in intimate contact with the outer surface of each driver IC 80, so that heat generated in the driver IC 80 can be dissipated efficiently. Boards 81 are placed above the driver ICs 80 and the heat sinks 82 and outside the FPCs 50. The space between the top faces of the heat sinks 82 and the boards 81 is sealed with a seal member 84 and the space between the lower faces of the heat sinks 82 and the FPCs 50 is sealed with the seal member 84.

Figure 4:
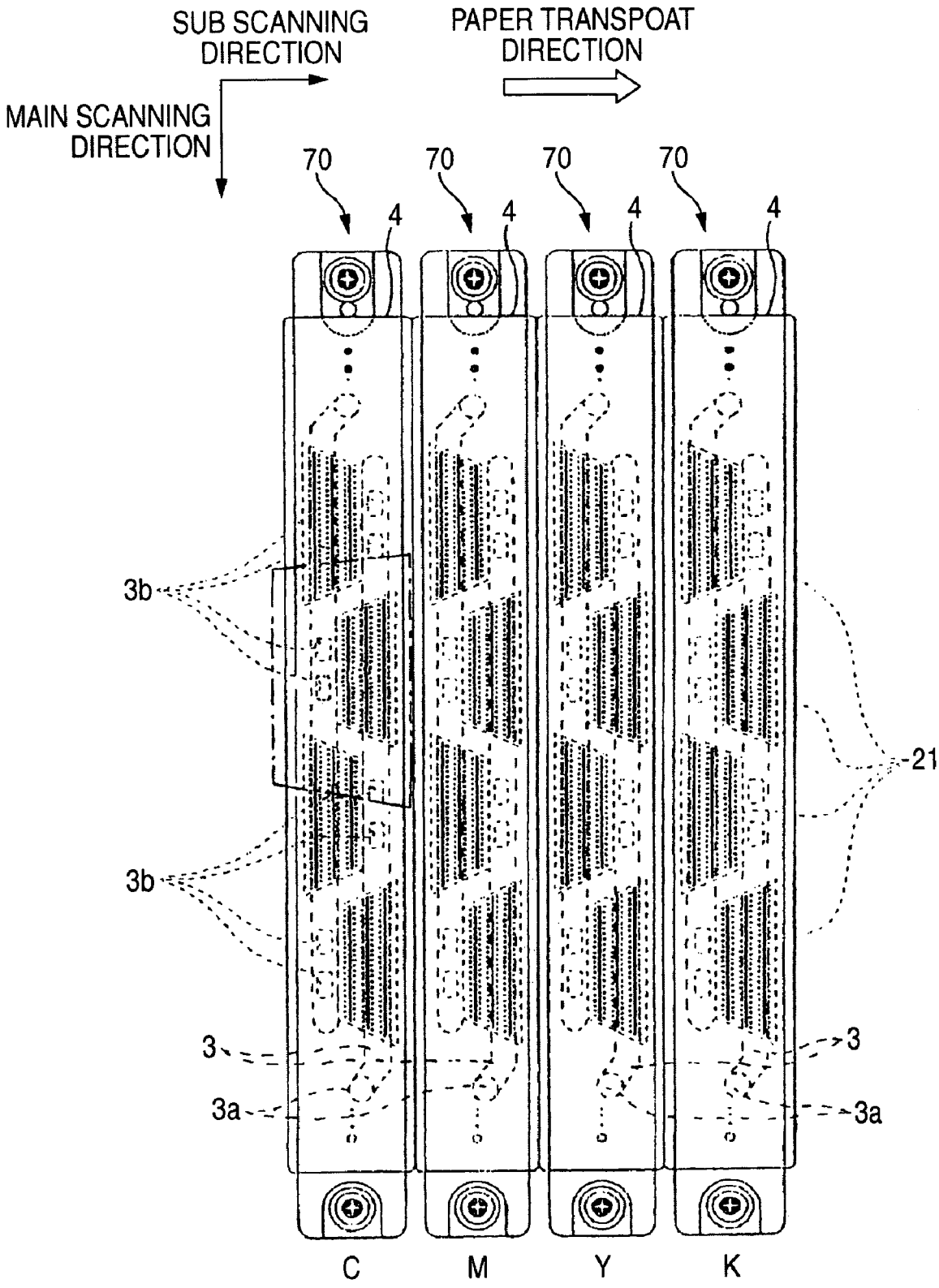
FIG. 4 is a plan view of head main bodies contained in the ink jet heads shown in FIG. 1.

FIG. 4 is a plan view of the head main bodies 70 of the inkjet heads 1*a* to 1*d*. In FIG. 4, the ink reservoirs 3 formed in the base blocks 71 are drawn virtually by dashed lines. The two ink reservoirs 3 along the length direction of the head main body 70 extend in parallel to and at a predetermined spacing from each other. Each of the two ink reservoirs 3 has an opening 3*a* at one end and is communicated with an ink tank (not shown) via the opening 3*a* and thus are always filled with ink. The plurality of openings 3*b* are provided in each ink reservoir 3 along the length direction of the head main body 70 for connecting the ink reservoir 3 and the flow passage unit 4 as described above. The openings 3*b* are placed close to each other in a pair along the length direction of the head main body 70. The pairs of the openings 3*b* communicating with one ink reservoir 3 and the pairs of the openings 3*b* communicating with the other ink reservoir 3 are provided in two lines in a staggered arrangement.

In an area where the opening 3*b* are not placed, the actuator units 21 each having a trapezoidal shape in a plain view are placed in two lines in a staggered arrangement in a pattern opposite to that of the pairs of the openings 3*b*. The opposed parallel sides (upper side and lower side) of each actuator unit 21 extends in a direction parallel to the length direction of the head main body 70. Oblique sides of the adjacent actuator units 21 partially overlap each other in the width direction of the head main body 70.

Figure 5:
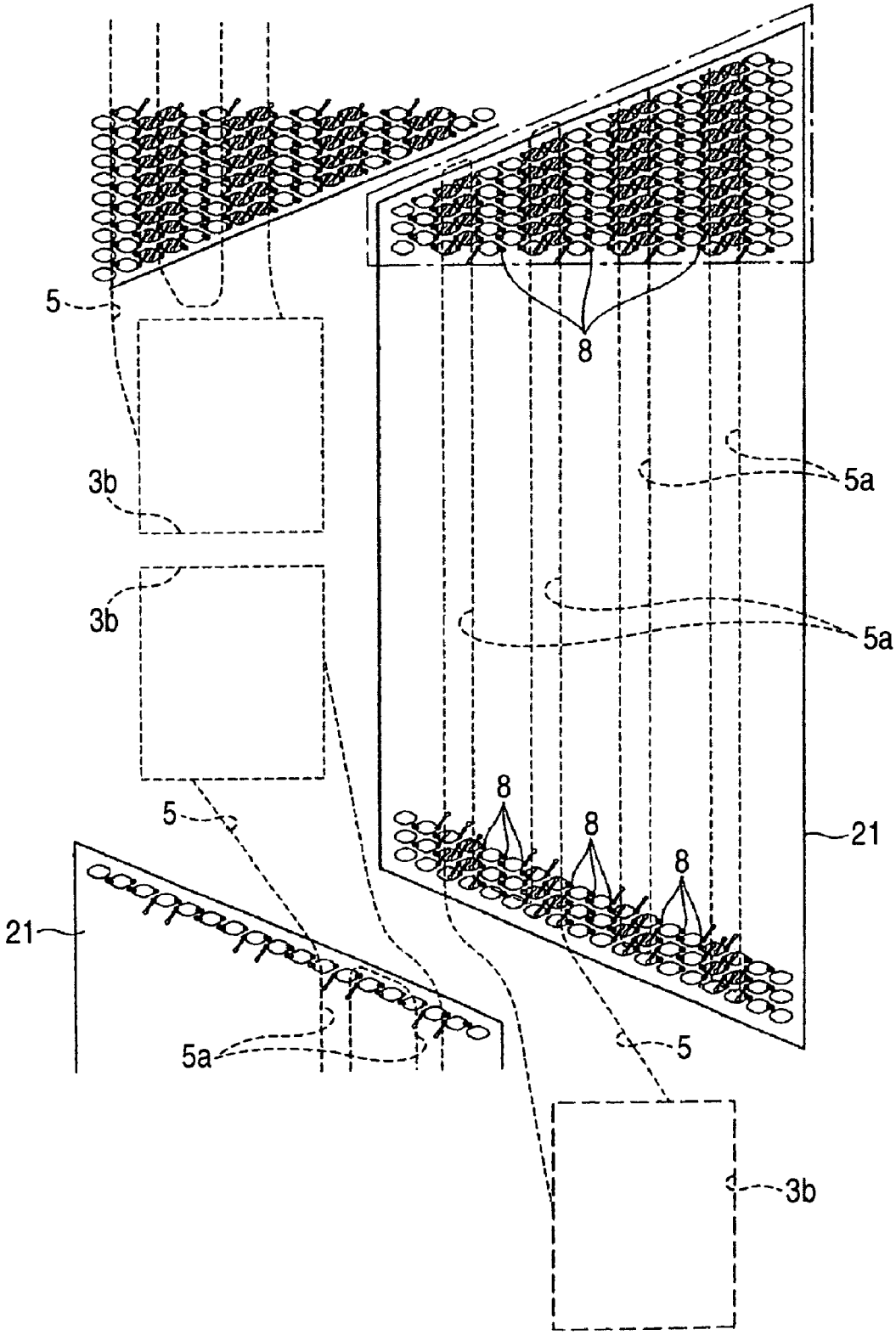
FIG. 5 is an enlarged view of the area surrounded by the alternate long and short dashed line drawn in FIG. 4.

FIG. 5 is an enlarged view of the area surrounded by the alternate long and short dashed line drawn in FIG. 4. As shown in FIG. 5, the openings 3*b* provided in each ink reservoir 3 communicate with respective manifolds 5 of common ink chambers. The tip of each manifold 5 is divided into two branches, forming submanifolds 5*a*. In the plan view, the two submanifolds 5*a* branched from each of the adjacent openings 3*b* extend from each of two oblique sides in the actuator unit 21. That is, four submanifolds 5*a* in total are separated from each other and extend below the actuator unit 21, along the opposed parallel sides of the actuator unit 21.

The lower face of the flow passage unit 4 is an ink ejection face and the area of the ink ejection face corresponding to the bonded area of each actuator unit 21 is an ink ejection area. The plurality of nozzles 8 are arranged in a matrix in the surface of each ink ejection area as described later. Only several nozzles B are drawn in FIG. 5 for simplicity of the drawing; in fact, the nozzles 8 are arranged over the whole ink ejection area of each actuator unit 21.

Figure 6:
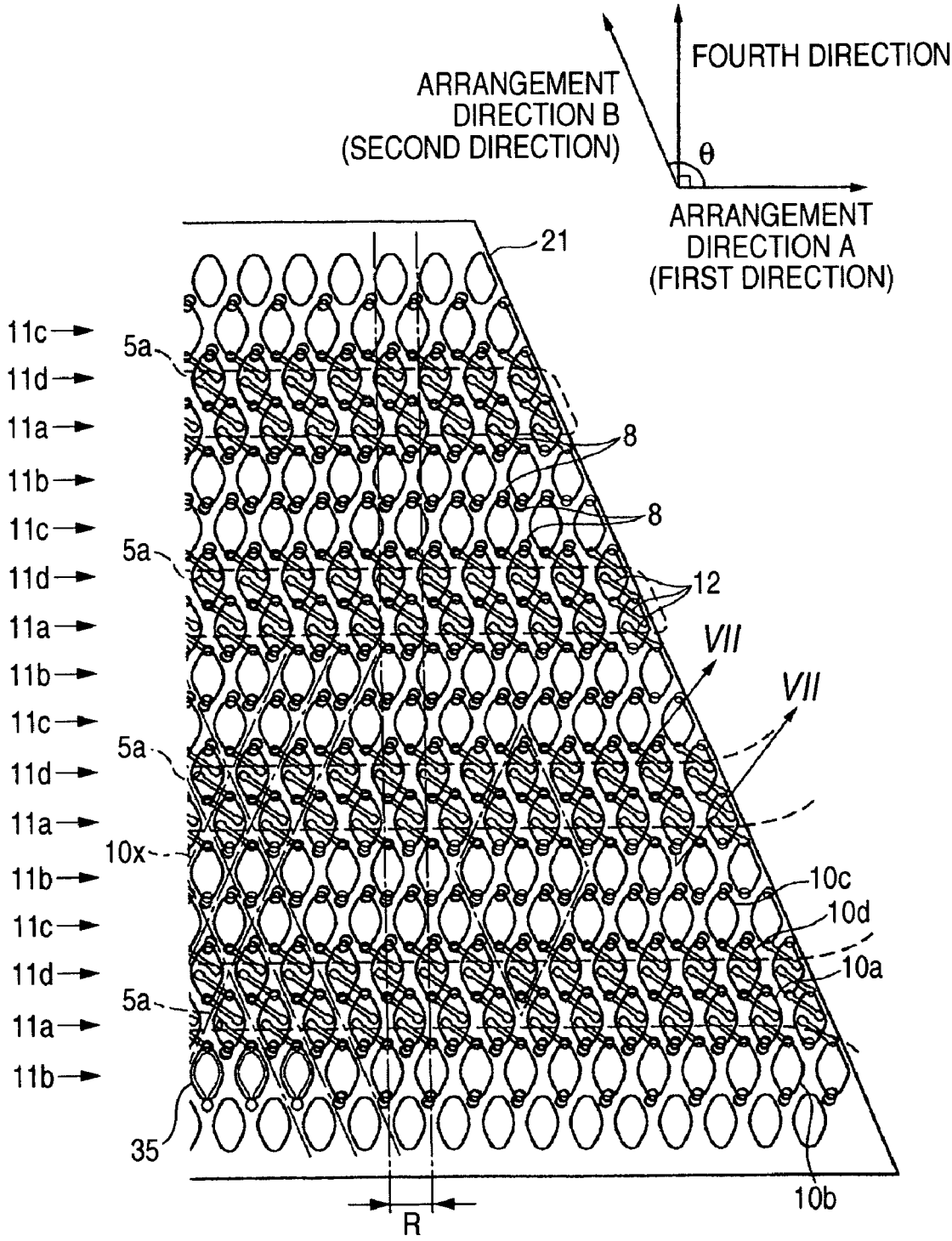
FIG. 6 is an enlarged view of the area surrounded by the alternate long and short dashed line drawn in FIG. 5.

FIG. 6 is an enlarged view of the area surrounded by the alternate long and short dashed line drawn in FIG. 5. FIG. 6 shows a state in which the plane where a plurality of pressure chambers 10 in the flow passage unit 4 are arranged in a matrix is viewed from the direction perpendicular to the ink ejection face. Each pressure chamber 10 has a substantially rhombic planer shape with corners rounded. Each pressure chamber 10 is arranged such that the longer diagonal line extends in parallel to the width direction of the flow passage unit 4. Each pressure chamber 10 communicates at one end with the nozzle 8 and at an opposite end with the submanifold 5*a* as the common ink flow passage through an aperture (see FIG. 6). At a position overlapping each pressure chamber 10 in the plan view, an individual electrode 35, which has a planer shape similar to the pressure chamber 10 and has a size smaller than pressure chamber 10, is formed on the actuator unit 21. Only some of the individual electrodes 35 are drawn in FIG. 6 for simplicity of the drawing. In FIGS. 5 and 6, the pressure chambers 10, the apertures 12, etc., to be drawn by dashed lines in the actuator unit 21 or the flow passage unit 4, are drawn by solid lines for easy understanding of the drawings.

As shown in FIG. 6, a plurality of rhombic areas 10*x*, which are imaginary areas indicated by a dot and dashed line and house the respective pressure chambers 10, are arranged in a matrix in two directions of an arrangement direction A (a first direction) and an arrangement direction B (a second direction) so that they are adjacent to each other without overlapping each other. The arrangement direction A is coincident with the length direction of the ink jet head 1*a*, namely, the extension direction of the submanifolds 5*a* and extends in a direction parallel with the shorter diagonal line of each rhombic area 10*x*. The arrangement direction B is coincident with one oblique line direction of the rhombic area 10*x* forming an obtuse angle θ with the arrangement direction A. Each pressure chamber 10 and each corresponding rhombic area 10*x* have a common center position, and the contours of the pressure chambers 10 and the corresponding rhombic areas 10*x* are separated from each other in the plan view.

The pressure chambers 10 adjacently arranged in a matrix in the two directions of the arrangement direction A and the arrangement direction B are separated from each other at the distance R corresponding to 37.5 dpi along the arrangement direction A. Eighteen pressure chambers 10 are arranged at the maximum in the arrangement direction B in each ink ejection area. However, the pressure chambers provided along each edge or outer line relative to the arrangement direction B, of each ink ejection area, are dummy and do not contribute to ink ejection.

The pressure chambers 10 arranged in a matrix form a plurality of pressure chamber rows along the arrangement direction A shown in FIG. 6. The pressure chamber rows are divided into first pressure chamber rows 11*a*, second pressure chamber rows 11*b*, third pressure chamber rows 11*c*, and fourth pressure chamber rows 11*d* in response to the relative positions to the submanifolds 5*a* when viewed from the direction perpendicular to the plane of FIG. 6 (third direction). The first to fourth pressure chamber rows 1*a* to 11*d* are alternately arranged in the third order of pressure chamber row 11*c*, the fourth pressure chamber row 11*d*, the first pressure chamber row 11*a*, and the second pressure chamber row 11*b* from the upper side to the lower side in each of the actuator units 21. Four each sets of the first to fourth pressure chamber rows 11*a* to 11*d* are arranged in each of the actuator units 21.

In the pressure chambers 10*a* making up the first pressure chamber rows 11*a* and the pressure chambers 10*b* making up the second pressure chamber rows 11*b*, the nozzles 8 are disposed on the lower side of the drawing sheet of FIG. 6 with respect to the direction orthogonal to the arrangement direction A (fourth direction) when viewed from the third direction. The nozzles 8 are positioned at the lower end parts of the corresponding rhombic areas 10*x*. On the other hand, in the pressure chambers 10*c* making up the third pressure chamber rows 11*c* and the pressure chambers 10*d* making up the fourth pressure chamber rows 11*d*, the nozzles 8 are disposed on the upper side of the drawing sheet of FIG. 6 with respect to the fourth direction. The nozzles 8 are positioned at the upper end parts of the corresponding rhombic areas 10*x*. In the first and fourth pressure chamber rows 11*a* and 11*d*, Half or more of the areas the pressure chambers 10*a* and 10*d* overlap the submanifolds 5*a* when viewed from the third direction. In the second and third pressure chamber rows 11*b* and 11*c*, no areas of the pressure chambers 10*b* and 10*c* overlap the submanifolds 5*a* when viewed from the third direction. Thus, it is made possible to widen the width of each submanifold 5*a* as much as possible for smoothly supplying ink to each pressure chamber 10 while preventing the nozzles 8 communicating with the pressure chambers 10 belonging to every pressure chamber row from overlapping the submanifolds 5*a*.

Figure 7:
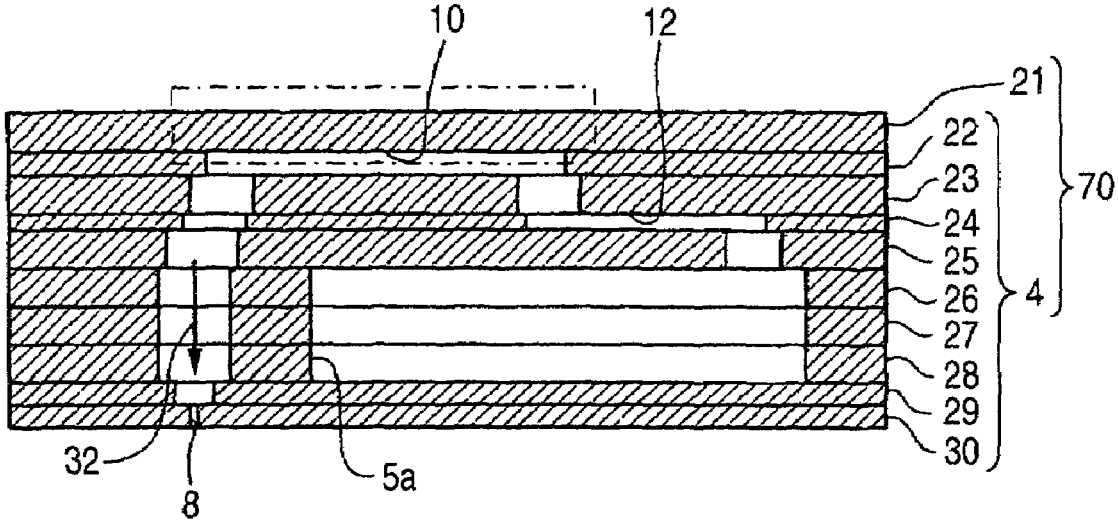
FIG. 7 is a fragmentary sectional view of the head main body taken on line VII-VII in FIG. 6.

Next, the cross-sectional structure of the head main body 70 will be further discussed with reference to FIG. 7. FIG. 7 is a sectional view taken on line VII-VII in FIG. 6 and illustrates the pressure chamber 10*a* belonging to the first pressure chamber row 11*a* As shown in FIG. 7, the nozzle 8 communicates with the submanifold 5*a* through the pressure chamber 10 (10*a*) and the aperture 12. Thus, the head main body 70 is formed with an individual ink flow passages 32 from the exit of the submanifold 5*a* to the nozzle 8 through the aperture 12 and the pressure chamber 10 for each pressure chamber 10.

The head main body 70 has a laminated structure, in which a total of ten sheet members, namely, of the actuator unit 21, a cavity plate 22, a base plate 23, an aperture plate 24, a supply plate 25, manifold plates 26, 27, and 28, a cover plate 29, and a nozzle plate 30, are arranged from the top to the bottom. The nine metal plates except the actuator unit 21 make up the flow passage unit 4.

The actuator unit 21 includes four piezoelectric sheets 41 to 44 (see FIG. 9), which are laminated one upon the other and provided with electrodes. In the actuator unit 21, a top layer has a portion which becomes active when an electric field is applied, which will be hereinafter referred to simply as "an active layer," because the electrodes are provided thereto remaining three layers are inactive layers as described later in detail. The cavity plate 22 is a metal plate provided with a plurality of substantially rhombic openings opposed to the pressure chambers 10. The base plate 23 is a metal plate provided with a communication hole connecting between the pressure chamber 10 and the aperture 12 and a communication hole from the pressure chamber 10 to the nozzle 8 for each pressure chamber 10 of the cavity plate 22. The aperture plate 24 is a metal plate provided with a communication hole front the pressure chamber 10 to the nozzle 8 as well as two holes and the aperture 12 connecting the two holes for each pressure chamber 10 of the cavity plate 22. The supply plate 25 is a metal plate provided with a communication hole connecting between the aperture 12 and the submanifold 5*a* and a communication hole from the pressure chamber 10 to the nozzle 8 for each pressure chamber 10 of the cavity plate 22. The manifold plates 26, 27, and 28 are metal plates each provided with a communication hole from the pressure chamber 10 to the nozzle 8 for each pressure chamber 10 of the cavity plate 22 in addition to holes which are joined to each other to make up the submanifold 5*a* when the manifold plates 26, 27, 28 are laminated one upon the other. The cover plate 29 is a metal plate provided with a communication hole from the pressure chamber 10 to the nozzle 8 for each pressure chamber 10 of the cavity plate 22. The nozzle plate 30 is a metal plate provided with the nozzle 8 for each pressure chamber 10 of the cavity plate 22.

Figure 8A:
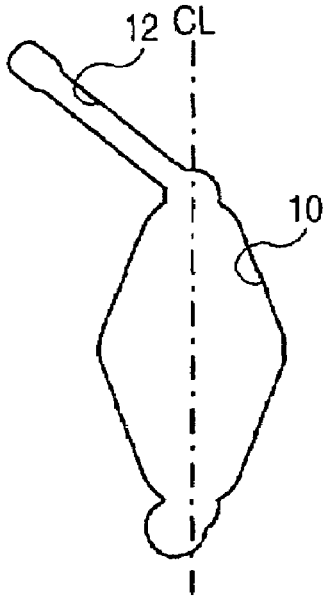
FIGS. 8A and 8B are drawings to show the shape of individual ink flow passages shown in FIG. 7.

The nine metal plates are mutually aligned and laminated one upon the other so as to form the individual ink flow passages 32. Each of the individual ink flow passages 32 first trends upward from the submanifold 5*a*, extends horizontally in the aperture 12, further trends upward therefrom, again extends horizontally in the pressure chamber 10, and trends slantingly downward in the direction away from the aperture 12, and then trends toward the nozzle 8 vertically downward. As shown in FIG. 8A, the planer shape, in the plane parallel with the ink ejection face, of the individual ink flow passages 32 including the pressure chamber 10 belonging to the pressure chamber row 11*a*, 11*b* when viewed from the direction orthogonal to the ink ejection face (third direction), is not symmetrical with respect to a center line CL of the pressure chamber 10 along the paper transport direction (the fourth direction) because the aperture 12 projects to the left. As shown in FIG. 5B, the planer shape, in the plane parallel with the ink ejection face, of the individual ink flow passages 32 including the pressure chamber 10 belonging to the pressure chamber row 11*c*, 11*d* when viewed from the direction orthogonal to the ink ejection face, is not symmetrical with respect to the center line CL of the pressure chamber 10 along the paper transport direction because the aperture 12 projects to the right.

Figure 9A:
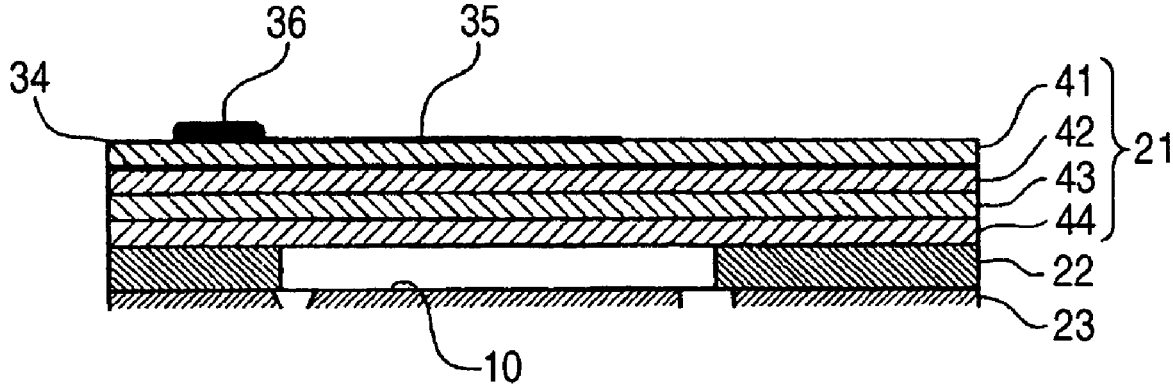
FIGS. 9A and 9B are drawings to show the structure of an actuator unit shown in FIG. 7.

Next, the detailed structure of the actuator unit 21 laid on the cavity plate 22 of the top layer in the flow passage unit 4 will be discussed with reference to FIGS. 9A and 9B. FIG. 9A is a fragmentary sectional view of the actuator unit 21 shown in FIG. 7, and FIG. 9B is a plan view of the actuator unit 21 shown in FIG. 9A.

As shown in FIG. 9A, the actuator unit 21 includes the four piezoelectric sheets 41 to 44 formed so as to have the same thickness of about 15 μm. The piezoelectric sheets 41 to 44 form a continuous layered flat plate (a continuous flat layer) so as to be placed spreading across the plurality of pressure chambers 10 formed in one ink ejection area in the head main body 70. As the piezoelectric sheets 41 to 44 are placed spreading across the plurality of pressure chambers 10 as the continuous flat layer, it is made possible to place individual electrodes 35 at high density on the piezoelectric sheet 41 by using a screen print technique, for example. Thus, it is also made possible to place at high density the pressure chambers 10 formed at the positions opposed to the individual electrodes 35, making it possible to print a high-resolution image. The piezoelectric sheets 41 to 44 are made of ceramic material based on lead zirconate titanate (PZT) having ferroelectricity.

The individual electrodes 35 are formed on the piezoelectric sheet 41 of the top layer. A common electrode 34 having a thickness of about 2 μm formed on the full face of the sheet intervenes between the piezoelectric sheet 41 of the top layer and the piezoelectric sheet 42 therebelow. The individual electrodes 35 and the common electrode 34 are made of metal material of Ag—Pd family, for example.

Figure 9B:
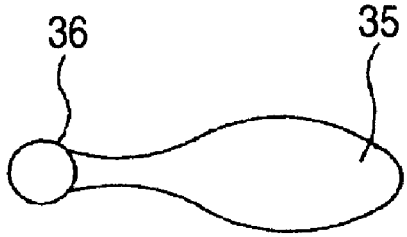

As shown in FIG. 9B, the individual electrodes 35 each have a thickness of about 1 μm and a substantially rhombic planer shape almost similar to each pressure chamber 10 and are arranged in a matrix (see FIG. 6). One of the acute angle parts of each rhombic individual electrode 35 is extended and the tip area is formed with a circular land part 36 having a diameter of about 160 μm, electrically connected to the individual electrode 35. The land part 36 is made of gold containing glass frit, for example, and is bonded onto the surface of the extended part of the individual electrode 35.

The land part 36, which is electrically joined to a contact provided on the FPC 50, is not opposed to the pressure chamber 10 and is placed so as to face the partition wall for partitioning the pressure chambers 10.

The common electrode 34 is grounded in an area not shown. Accordingly, the common electrode 34 is kept equally at ground potential in the areas opposed to all pressure chambers 10. Each individual electrode 35 is electrically connected to the driver IC 80 through the land part 36 and the FPC 50 including a separate lead wire for each individual electrode 35 so that the potential can be controlled for each individual electrode 35 opposed to each pressure chamber 10 (see FIGS. 1 and 2).

Next, a drive method of the actuator unit 21 will be discussed. The polarization direction of the piezoelectric sheet 41 in the actuator unit 21 is the thickness direction. That is, the actuator unit 21 adopts a unimolf type configuration wherein the piezoelectric sheet 41 on the top (namely, distant from the pressure chamber 10) is the active layer and the three piezoelectric sheets 42 to 44 on the lower side (namely, near to the pressure chamber 10) are the inactive layers. Therefore, assuming that the individual electrode 35 is set to a predetermined positive or negative potential, if the electric field and polarization are in the same direction, the electric field application portion sandwiched between the electrodes in the piezoelectric sheet 41 of the active layer becomes active and shrinks in the direction at right angles to the polarization direction by the piezoelectric transverse effect. On the other hand, the piezoelectric sheets 42 to 44 do not receive the effect of the electric field and thus do not spontaneously shrink and therefore the top piezoelectric sheet 41 and the lower piezoelectric sheets 42 to 44 differ in distortion in the direction vertical to the polarization direction and the whole of the piezoelectric sheets 41 to 44 attempts to become deformed so as to become convex to the inactive side (unimolf deformation). At this time, the lower face of the piezoelectric sheets 41 to 44 (actuator unit 21) is fixed to the top face of the cavity plate 22 for defining the pressure chambers 10 and consequently the piezoelectric sheets 41 to 44 become deformed so as to become convex to the pressure chamber side. Thus, the volume of the pressure chamber 10 lowers and the ink pressure rises, ejecting an ink droplet from the nozzle 8. Then, if the individual electrode 35 is restored to the same potential as that of the common electrode 34, the piezoelectric sheets 41 to 44 become the original shape and the volume of the pressure chamber 10 is restored to the original volume, so that ink is sucked from the manifold 5 side.

In the actuator units 21, the individual electrodes 35 are placed, in advance, at a potential higher than that of the common electrode 34, which will be hereinafter referred to as high potential. Everytime an ejection request is made, the individual electrode 35 are once placed at a potential that is the same as that of the common electrode 34, which will be hereinafter referred to as low potential, and then are returned to the high potential at a predetermined timing. Accordingly, the piezoelectric sheets 41 to 44 are restored to the original state at the timing at which the individual electrodes 35 are placed at the low potential, and the volume of the pressure chambers 10 increase as compared with a case where the actuator units 21 are in the initial state (in which the individual electrodes 35 and the common electrode 34 differ in potential). At this time, a negative pressure is given to the inside of the pressure chambers 10, a pressure wave of the negative pressure propagates to the individual ink flow passages 32, and ink is sucked from the manifold 5 side into the pressure chambers 10. Then, the piezoelectric sheets 41 to 44 become deformed so as to become convex toward the pressure chamber 10 side again at the timing at which the individual electrodes 35 are placed at the high potential. As the volume of the pressure chamber 10 decreases, the internal pressure of the pressure chambers 10 is changed to a positive pressure and the ink pressure in the pressure chambers 10 is increased and ink droplets are ejected from the nozzles 8. That is, to eject an ink droplet, a pulse whose reference potential is high, is supplied to the individual electrodes 35. It is ideal with a width of the pulse is AL (Acoustic Length) which is a propagation time length of the pressure waves from the manifold 5 to the nozzles 8 in the pressure chambers 10. According to the ideal pulse width, when the internal pressure of the pressure chambers 10 is changed to a positive pressure from a negative pressure, both the positive pressures are generated by the volume decrease of the pressure chambers 10 and generated by the change of the internal pressure combined in the pressure chambers, so that an ink droplet can be ejected from the nozzles 8 by strong pressure.

In gradation print, each gradation level is expressed by the ink amount (volume) to be adjusted by the number of ink droplets to be ejected from the nozzle 8, namely, the number of ink ejection times. Thus, ink droplets are ejected successively from the nozzle 8 corresponding to the specified dot area, as many times as the number of times corresponding to the specified gradation level. Generally, in case where the ink droplets are successively ejected, the interval between pulses to be supplied for ejecting the ink droplets is preferably set to the AL. Accordingly, a peak of a residual pressure wave of a previous pressure generated when a previous ink droplet was ejected and a peak of a pressure wave of a subsequent pressure generated when an ink droplet is ejected is coincident with each other in the periods thereof and the previous pressure and the subsequent pressure are superposed and thus, the pressure for ejecting an ink droplet is amplified.

Although ink droplets are ejected from the nozzle 8 in such a manner as described above, the ink droplet ejection characteristic may slightly vary among the nozzles 8 because of a manufacturing error of the individual ink flow passages 32, etc. The AL used for the pulse width and the pulse interval is a numeric value that can be applied if the head main body 70 has an ideal structure; in fact, the AL is appropriately corrected for application. For convenience, in the description to follow, it is assumed that the head main body 70 has an ideal structure and that an error does not exist in any individual ink flow passages 32.

Figure 10:
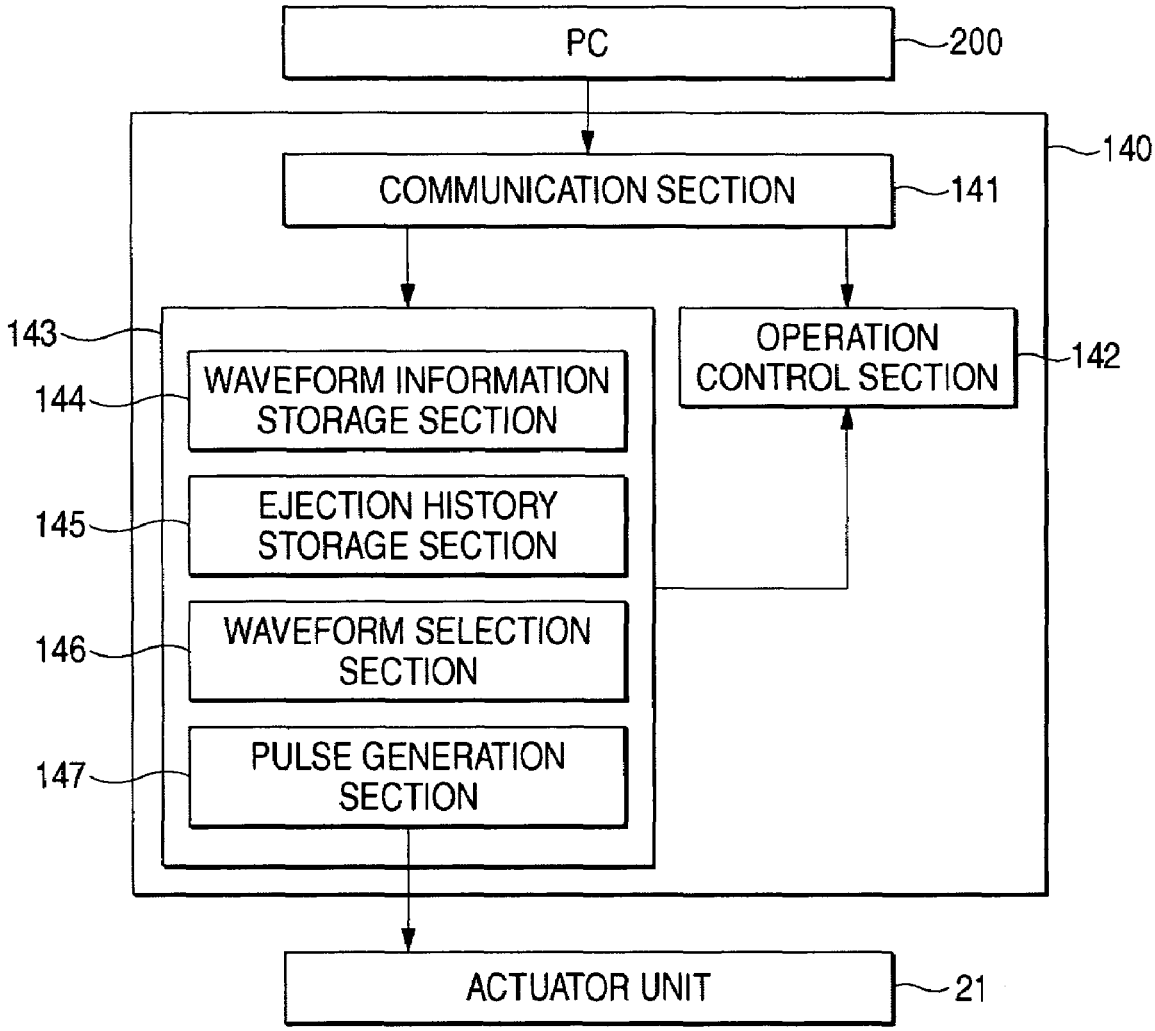
FIG. 10 is a functional block diagram of a controller shown in FIG. 1.

Next, the controller 140 will be discussed in detail with reference to FIG. 10. FIG. 10 is a functional block diagram of the controller 140. The controller 140 includes a CPU (Central Processing Unit) of an arithmetic processing unit, ROM (Read-only Memory) storing a program to be executed by the CPU and data to be used with the program, and RAM (Random Access Memory) for temporarily storing data during program execution. As the components function, other functional sections described just below are caused to function.

The controller 140 operates based on an instruction from the PC 200 and includes a communication section 141, an operation control section 142, and a print control section 143 as shown in FIG. 10. The functional sections are hardware implemented as an ASIC (Application-Specific Integrated Circuit), etc., but all or some of the functional sections may be implemented as software.

The communication section 141 conducts communications with the PC 200. An operation instruction transmitted from the PC 200 is output to the operation control section 142, and a print instruction transmitted from the PC 200 is output to the print control section 143. The operation control section 142 controls the transport motor 150 for driving the belt rollers 106 and 107 and a motor for driving the feed rollers 105*a* and 105*b*, based on instructions from the PC 200 and the print control section 143. The print control section 143 executes print based on a print instruction from the PC 200 and includes a waveform information storage section 144, an ejection history storage section 145, a waveform selection section 146, and a pulse generation section 147.

Figure 11:
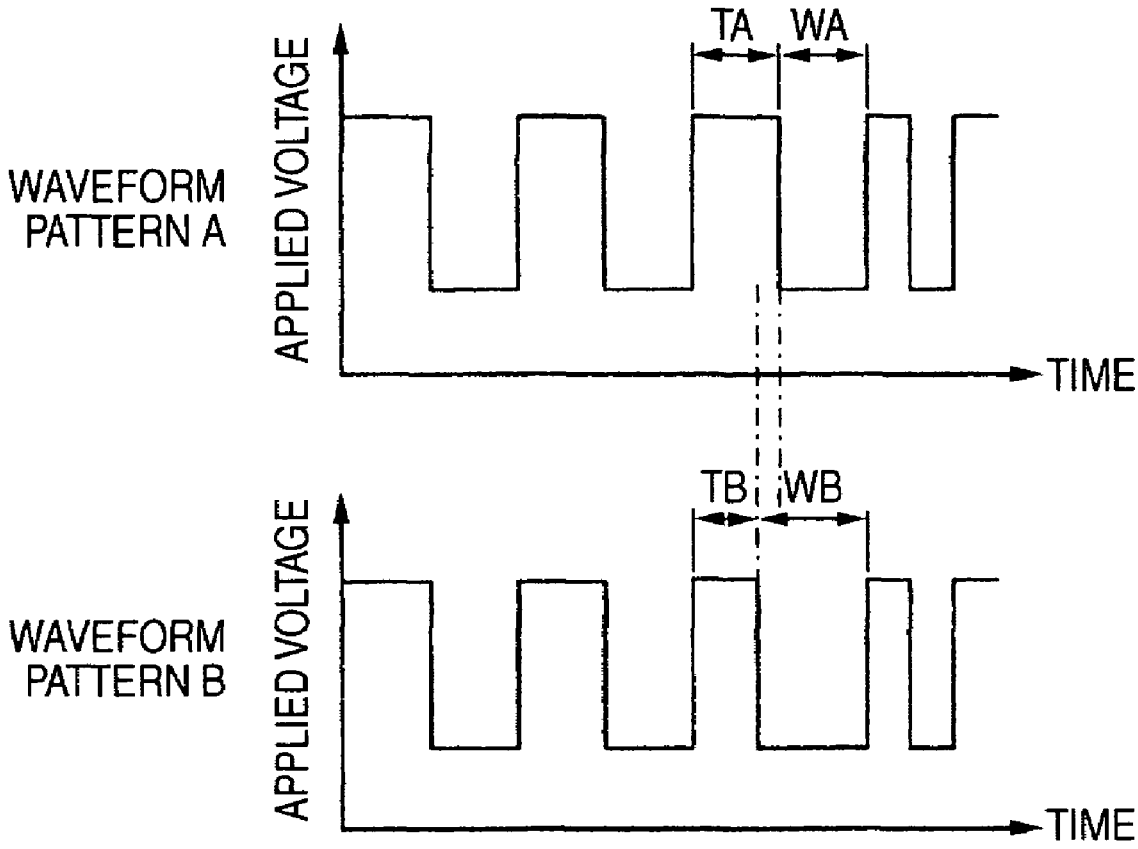
FIG. 11 shows examples of waveform patterns stored in waveform information storage section shown in FIG. 10.

The waveform information storage section 144 stores the waveform pattern (information concerning drive signal) of a pulse string (drive signal) supplied to the individual electrode 35 to eject an ink droplet from the nozzle 8 for forming a dot on print paper. The waveform information storage section 144 stores two types of waveform patterns of waveform pattern A (waveform information concerning a first drive signal) and waveform pattern B (waveform information concerning a second drive signal) with respect to all gradations adjusted for each nozzle 8. FIG. 11 shows examples of the waveform pattern A and the waveform pattern B. The vertical axis indicates applied voltage and the horizontal axis indicates the time in FIG. 11.

Each of the waveform pattern A and the waveform pattern B shown in FIG. 11 is the waveform pattern of pulses supplied to the individual electrode 35 to eject an ink droplet from the nozzle 8 when a dot having a gradation level represented by three ink droplets is formed. A pulse with the high potential as the reference is supplied to the individual electrode 35 as described above. As shown in FIG. 11, each of the waveform pattern A and the waveform pattern B is made up of four continuous pulses; the first three pulses are supplied for successively ejecting three ink droplets and the last pulse is a cancel pulse to remove the residual pressure remaining in the individual ink flow passages 32 after ink ejection. The cancel pulse causes a new pressure to be generated in the individual ink flow passages 32 at the timing of the inverted period with respect to the period of the residual pressure. Accordingly, the residual pressure is canceled out by the pressure generated by the cancel pulse. The cancel pulse is formed as a part of the waveform pattern A or the waveform pattern B, but may be formed as a waveform pattern C (waveform information concerning a third drive signal) separated from the waveform patterns A and B. In this case, the waveform pattern A or the waveform pattern B may be followed by the waveform pattern C to form a new waveform pattern.

In the waveform pattern A, in the pulses for successively ejecting three ink droplets, the pulse width and the pulse interval are each substantially the AL. For example, the pulse interval between the second and third pulses (TA) and the pulse width of the third pulse (WA) are each substantially the AL. In contrast, in the waveform pattern B, in the pulses for successively ejecting the first two ink droplets, the pulse width and the pulse interval are each substantially the AL, but the pulse interval between the second and third pulses (TB) is shorter than the AL and the pulse width of the third pulse (WB) is longer than the AL. The waveform pattern A and the waveform pattern B are identical in the rising timing of the third pulse and the timing of the cancel pulse. Thus, the waveform pattern A and the waveform pattern B differ in the pulse interval between the second and third pulses (TA, TB) and the pulse width of the third pulse (WA, WB), namely, differ only in the start timing of the pulse for ejecting the last ink droplet (falling timing).

Hereinafter, the pulse for ejecting the last ink droplet, of the waveform pattern B will be referred to as deformation pulse and the pulse for ejecting the other ink droplet will be referred to as normal pulse. This relationship also applies to the waveform pattern A and the waveform pattern B in the other gradation levels. In the waveform pattern for forming a dot having a gradation level represented by one ink droplet, only the pulse width differs between the waveform pattern A and the waveform pattern B.

The ejection history storage section 145 stores the gradation level data of the formed dots and the used waveform pattern (waveform pattern A or waveform pattern B), with respect to a maximum of most recent ninety nine (n) dots successively formed for each nozzle 8. If either the gradation level data of the formed dots or the used waveform pattern changes in each nozzle 8, the storage contents in the ejection history storage section 145 are reset.

To form a dot on print paper, the waveform selection section 146 selects the waveform pattern to be used from the waveform patterns stored in the waveform information storage section 144 based on the history stored in the ejection history storage section 145. The waveform pattern to be used is determined based on a successive selection inhibition count n of the same waveform pattern in each nozzle 8 and the placement position of the nozzle 8. The successive selection inhibition count n is the count for inhibiting successive selection of the same waveform pattern. If the waveform pattern selected to form a dot in each nozzle 8 has been used n−1 successive times most recently, a waveform pattern different from the successively used waveform pattern is selected. For example, when the successive selection inhibition count n is 100, if the ejection history storage section 145 stores the fact that the waveform pattern most recently selected 99 times is the waveform pattern A, the waveform pattern B is selected. In contrast, if the ejection history storage section 145 stores the fact that the waveform pattern most recently selected 99 times is the waveform pattern B, the waveform pattern A is selected. At this time, in the nozzle row made up of the nozzles 8 placed adjacently in the direction orthogonal to the transport direction of print paper, the same waveform pattern is selected for the nozzles 8. The successive selection inhibition count n can be set in the range of 2 to 100 as desired. The pulse generation section 147 reads the data of the waveform pattern selected by the waveform selection section 146 from the waveform information storage section 144 and generates pulses corresponding to the selected waveform pattern. The pulses generated by the pulse generation section 147 are supplied to the corresponding individual electrode 35 of the actuator unit 21. Accordingly, the actuator unit 21 is driven and ink droplets are ejected in response to the selected waveform pattern from the corresponding nozzle 8, and thus, a desired dot is formed on print paper.

Figure 12:
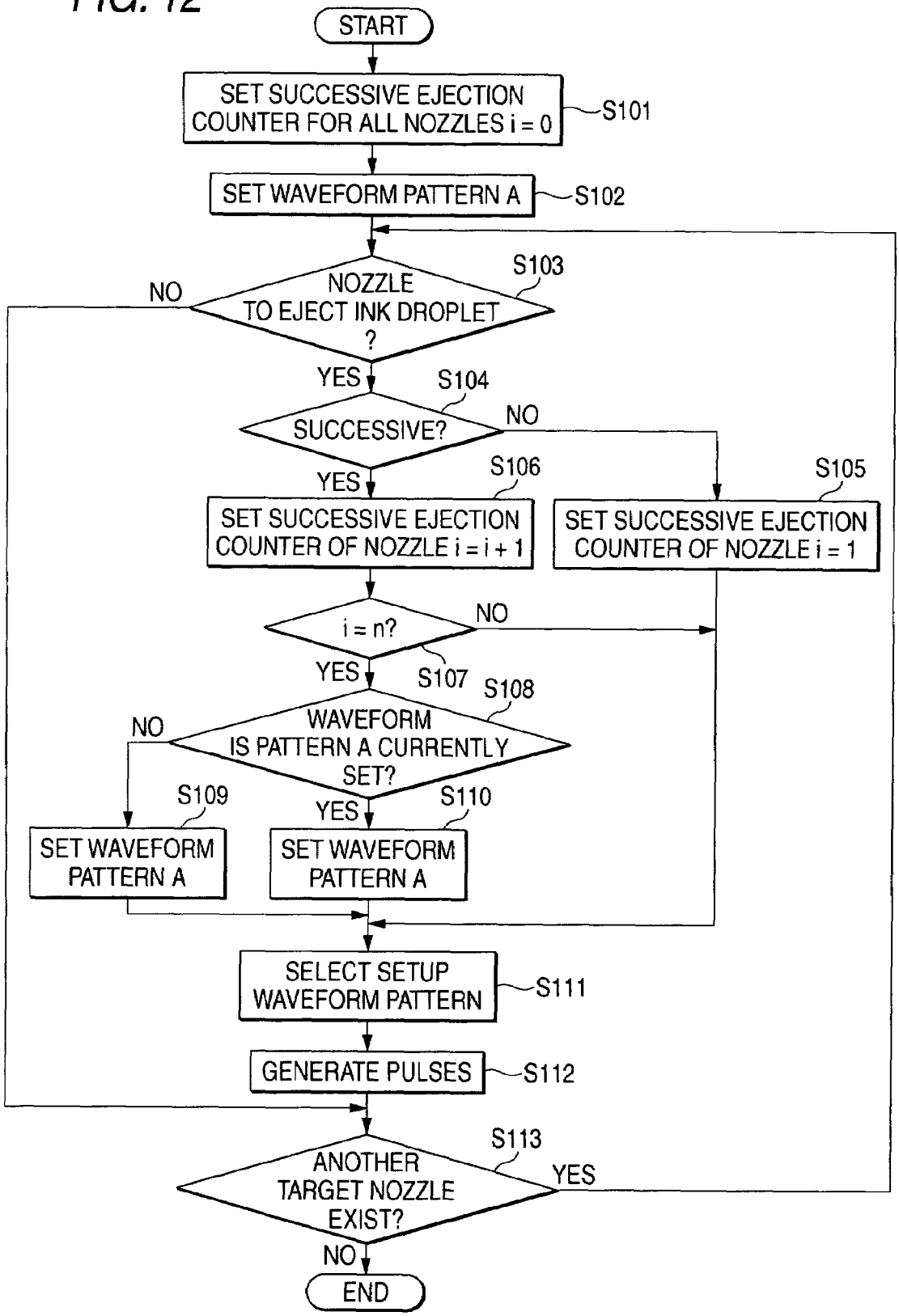
FIG. 12 is a flowchart to show the operation of a print control section.

Next, the operation of the print control section 143 will be discussed with reference to FIG. 12. FIG. 12 is a flowchart to show the operation of the print control section 143. The print control section 143 is started up based on a print instruction from the PC 200 operated by the user. As shown in FIG. 12, after the print control section 143 is started, flow goes to step S101 to initialize the history stored in the ejection history storage section 145 and a successive ejection counter i set for all nozzles 8 to 0 (zero). The successive ejection counter i counts the number of times the waveform pattern has been successively used most recently based on the history in each nozzle B. Then, flow goes to S102 to set the waveform selection section 146 so as to select the waveform pattern A as the initial value in all nozzles S.

Then, flow goes to S103 to determine which nozzle should eject an ink droplet, with respect to each nozzle 8, in order, based on the print data received from the PC 200. If the print control section 143 determines that the target nozzle 8 is the nozzle to eject an ink droplet (YES at S103), flow goes to S104. On the other hand, if the print control section 143 determines that the target nozzle 8 is not the nozzle to eject an ink droplet (NO at S103), flow goes to S112.

At S104, the print control section 143 determines whether or not the most recently used waveform pattern is the same as the waveform pattern set in the waveform selection section 146 based on the history stored in the ejection history storage section 145. If the print control section 143 determines that the most recently used waveform pattern is not the same as the waveform pattern set in the waveform selection section 146 (NO at S104), flow goes to S105 to set the successive ejection counter i of the target nozzle 8 to 1 and then goes to S111. On the other hand, if the print control section 143 determines that the most recently used waveform pattern is the same as the waveform pattern set in the waveform selection section 146 (YES at S104), flow goes to S106 to increment the successive ejection counter i of the nozzle 8 by one. Then, flow goes to S107 to determine whether or not the successive ejection counter i is equal to the successive selection inhibition count n. If the print control section 143 determines that the successive ejection counter i is not equal to the successive selection inhibition count n (NO at S107), flow goes to S111. If the print control section 143 determines that the successive ejection counter i is equal to the successive selection inhibition count n (YES at S107), flow goes to S108.

At S108, the print control section 143 determines whether or not the waveform pattern currently set in the waveform selection section 146 is the waveform pattern A. If the print control section 143 determines that the currently-set waveform pattern is not the waveform pattern A (NO at S108), flow goes to 5109 to set the waveform pattern A and then goes to S111. On the other hand, if the print control section 143 determines that the currently-set waveform pattern is the waveform pattern A (YES at S108), flow goes to S110 to set the waveform pattern B and then goes to S111.

At Sill, the waveform selection section 146 selects the set waveform pattern as the waveform pattern to be used. Then, flow goes to S112. At S112, the pulse generation section 147 generates pulses based on the waveform pattern selected by the waveform selection section 146. The generated pulses are supplied to the individual electrode 35 corresponding to the target nozzle 8. Then, flow goes to S113 to determine whether or not another target nozzle 8 exists. If the print control section 143 determines that another target nozzle 8 exists (YES at S113), flow again goes to 5103 to execute the processing described above. If the print control section 143 determines that another target nozzle 8 does not exist (NO at S113), the processing in the flowchart of FIG. 12 is terminated.

Figure 13:
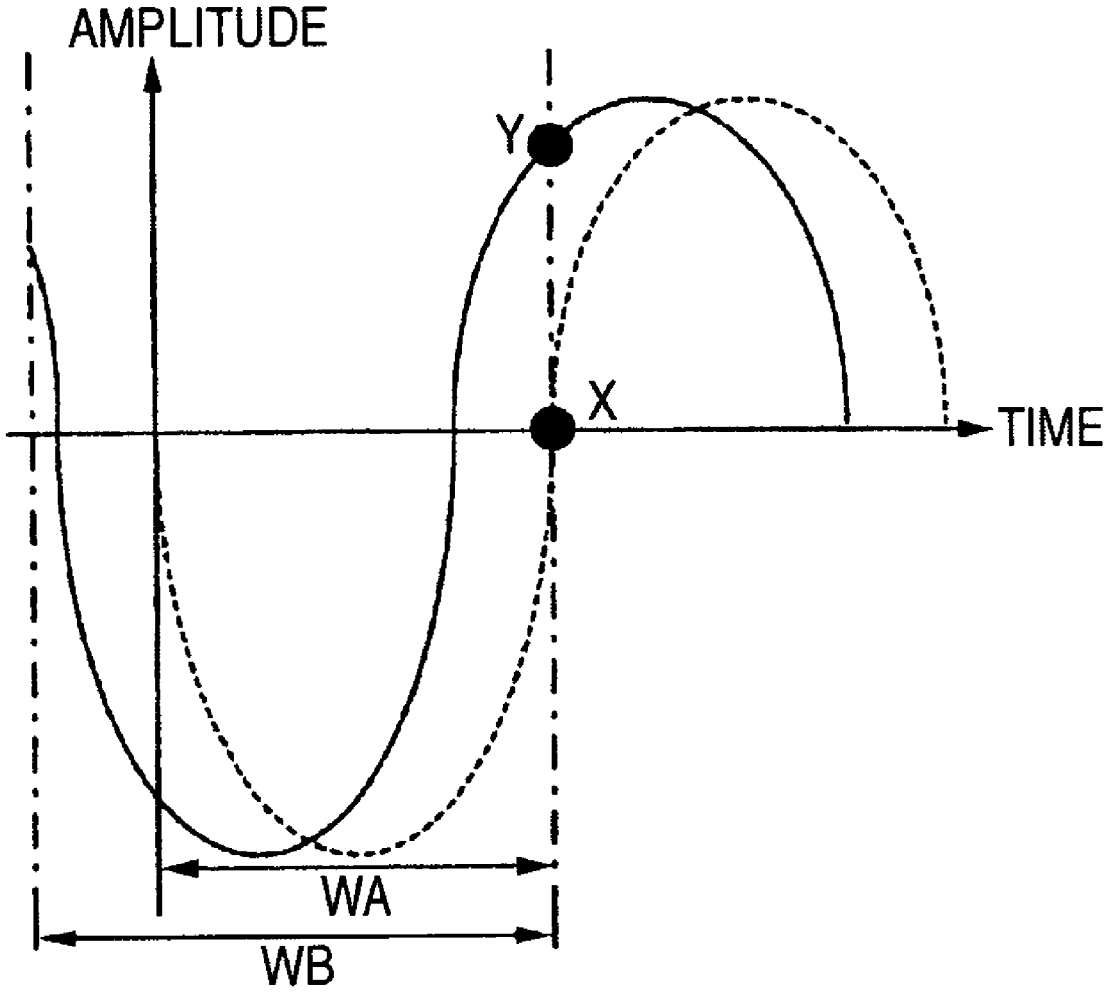
FIG. 13 is a drawing to show the vibration state of a meniscus in a nozzle shown in FIG. 7.

Next, the ink ejection operation when the pulses generated by the pulse generation section 147 based on the waveform pattern are supplied to the individual electrode 35 will be discussed with reference to FIGS. 13 and 14. FIG. 13 is a drawing to show the vibration state of an ink meniscus in the nozzle 8 when an ink droplet is ejected. The vertical axis indicates the vibration amplitude of the meniscus, and the horizontal axis indicates the time. The waveform indicated by the solid line shows the state of the ink meniscus in the case where an ink droplet is ejected according to a deformation pulse, and the waveform indicated by the dashed line shows the state of the ink meniscus in the case where an ink droplet is ejected according to a normal pulse (see FIG. 11). FIG. 14 is a drawing to show the cross-sectional shape of the ink meniscus when an ink droplet is ejected. The arrow in the figure indicates the displacement rate. When a pulse is supplied for ejecting an ink droplet, the volume of the pressure chamber 10 is once increased and then reduced by the deformation of the actuator unit 21 as described above. At this time, a pressure wave occurs in the individual ink flow passages 32 and thus the ink meniscus vibrates in synchronization with the vibration period of the pressure wave as shown in FIG. 13. The pulses for ejecting ink droplets include the normal and deformation pulses as described above. The ink droplet ejection operations when the normal pulses are supplied and when the deformation pulses are supplied will be discussed below in order.

Figure 8B:
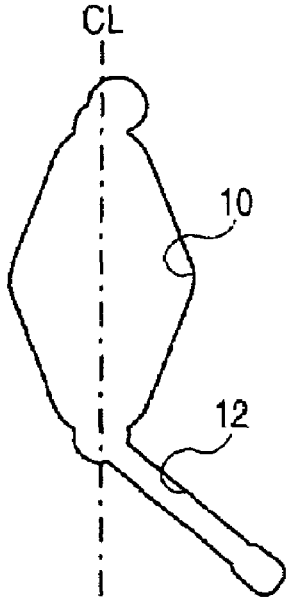
Figure 14A:
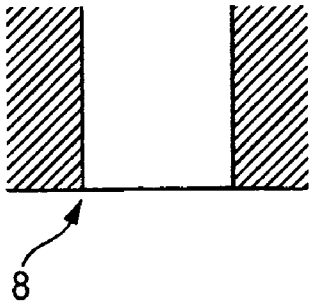
FIG. 14A to 14F are drawings to show the shape of a meniscus in the nozzle shown in FIG. 7.
Figure 14B:
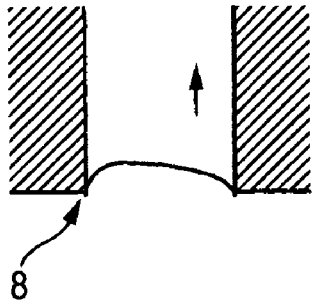
Figure 14C:
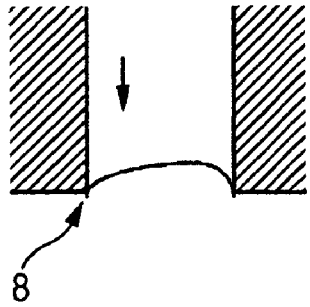
Figure 14D:
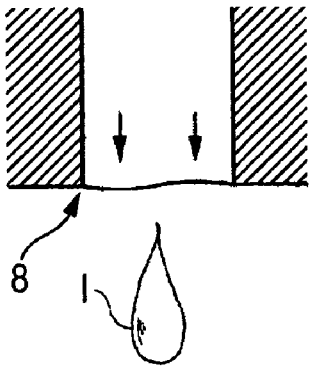

First, the case where normal pulses are supplied will be discussed. A pressure wave does not occur in the individual ink flow passages 32 at the instant when a first normal pulse is applied, and the meniscus amplitude and displacement rate are 0 as shown in FIG. 14A. At the instant when a second or subsequent normal pulse is applied, the pressure wave generated by the normal pulse which was applied just before the second or subsequent normal pulse is applied, remains in the individual ink flow passages 32 as a residual pressure wave. Because the residual pressure wave and a newly generated pressure wave are synchronized with each other in the AL period, the meniscus amplitude becomes 0 and the meniscus displacement rate becomes minus. After the normal pulse is applied, a pressure wave of a negative pressure occurs in the individual ink flow passages 32 in synchronization with the falling edge of the pulse. Accordingly, the pressure in the nozzle 8 also becomes a negative pressure and the meniscus is displaced in the minus direction (toward the pressure chamber 10 side), as shown in FIG. 14B. At this time, the pressure wave propagates nonuniformly because the shape of the individual ink flow passages 32 viewed from the ink ejection face is not symmetrical with respect to the center line CL of the pressure chamber 10 along the paper transport direction (see FIG. 8), and thus the meniscus is displaced while it is distorted in one direction. Then, the pressure wave of negative pressure arrives at the wall of the pressure chamber 10 nozzle 8 and is reflected off the wall of the pressure chamber 10. Accordingly, the negative pressure in the nozzle 8 gradually decreases and the meniscus is displaced from the minus direction to the plus direction (toward the opening side), as shown in FIG. 14C. Also at this time, the pressure wave is nonuniformly reflected in the ink flow passage 32 and thus the meniscus is displaced while it is distorted in one direction.

Figure 14E:
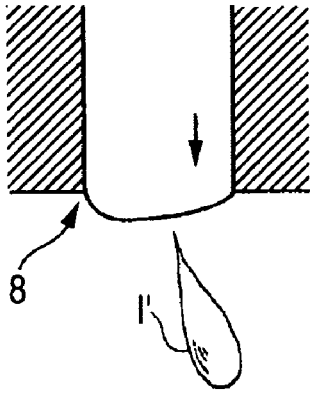
Figure 14F:
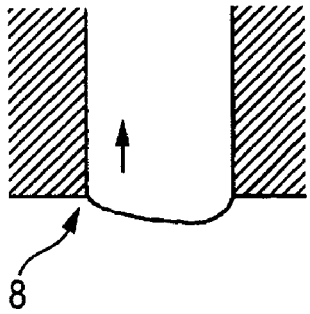

When the meniscus amplitude becomes 0, a pressure wave of a positive pressure occurs in the individual ink flow passages 32 in synchronization with the rising edge of the pulse and an ink droplet is ejected from the nozzle 8 (a point X in FIG. 13). At this time, when the meniscus amplitude is 0, the displacement rate is uniform in all area of the meniscus and thus an ink droplet I is ejected in the direction perpendicular to the opening plane of the nozzle 8 (in the direction perpendicular to the ink ejection face), as shown in FIG. 11D. Then, the pressure in the nozzle 8 becomes a positive pressure and the meniscus is displaced in the plus direction (toward the opening side), as shown in FIG. 14E. Also at this time, the pressure wave propagates nonuniformly and thus the meniscus is displaced while it is distorted in one direction. Then, the pressure wave of the positive pressure arrives at the nozzle 8 and is reflected off the nozzle 8. Accordingly, the positive pressure in the nozzle 8 gradually decreases and the meniscus is displaced from the plus direction to the minus direction, as shown in FIG. 14F. Also at this time, the pressure wave is nonuniformly reflected in the ink flow passages 342 and thus the meniscus is displaced while it is distorted in one direction. As described above, when the second or subsequent normal pulse is applied, the residual pressure wave generated by the normal pulse applied just before the second or subsequent normal pulse is applied and the newly generated pressure wave are synchronized with each other in the AL period and thus the meniscus amplitude becomes a little large, but phase change does not occur. Thus, the ink ejection operation when the first normal pulse is applied and that when the second or subsequent normal pulse is applied become substantially the same.

Next, the case where a deformation pulses are supplied will be discussed. Basically, when a deformation pulse is applied, a meniscus also vibrates as a normal pulse is applied, because the meniscus vibration frequency depends on the AL of the propagation time length of a pressure wave. As shown in FIG. 13, the falling timing of the deformation pulse is earlier than the falling timing of the normal pulse. Specifically, when the meniscus is displaced from the plus direction to the minus direction, the deformation pulse falls, as shown in FIG. 14F. Accordingly, a phase lead of the meniscus vibration waveform occurs as compared with the meniscus vibration waveform when the normal pulse is applied, and the rising timing of the deformation pulse, namely, the ink droplet ejection timing is shifted to the time at which the meniscus amplitude almost reaches its peak on the plus side from the time at which the meniscus amplitude is 0 (a point Y in FIG. 13). At the timing, the meniscus is distorted so as to project in one direction as shown in FIG. 14E and the displacement rate of the meniscus on the non-projection side is higher than the displacement rate of the meniscus on the projection side. Thus, when the deformation pulse is applied, an ink droplet I' is ejected in a direction toward the side where the meniscus does not project. The ejected ink droplet I' hits the print paper at a position deflected in the direction orthogonal to the print paper transport direction. Since the residual pressure wave in the individual ink flow passages 32 generated by the preceding normal pulse is combined with the pressure wave generated by the following normal pulse, the actual waveform cannot be represented by a curved line like a sin curve as shown in FIG. 13, but the waveform is simply shown for convenience of the description.

Figure 15:
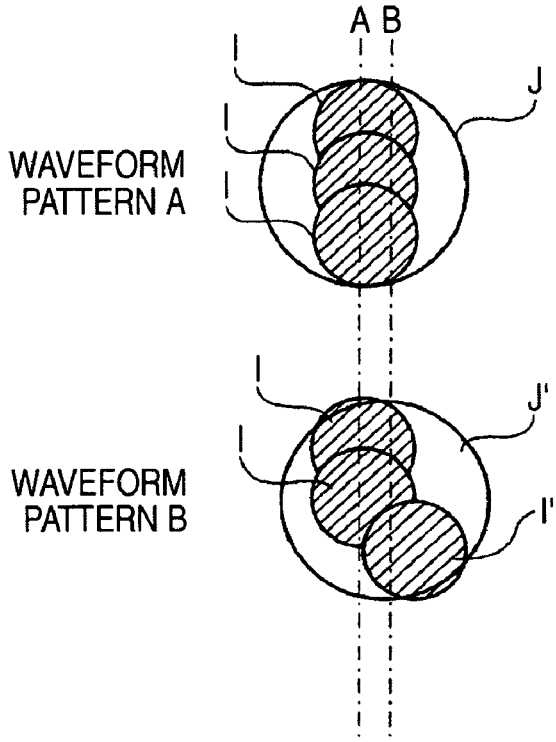
FIG. 15 is a drawing to show ink droplets ejected from the nozzle shown in FIG. 7 and dots formed by the ink droplets.
Figure 16:
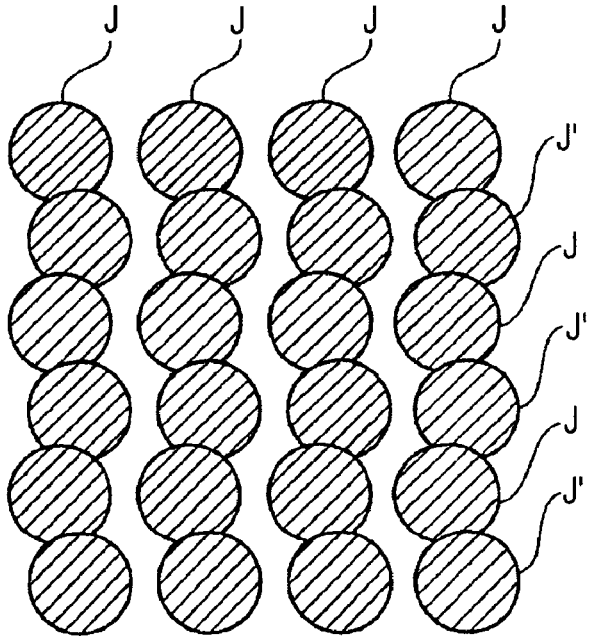
FIG. 16 is a drawing to show the print result of the ink jet head shown in FIG. 1.

Next, the print result when ink droplets are ejected based on the waveform pattern A and the waveform pattern B shown in FIG. 11 will be discussed with reference to FIGS. 15 and 16. FIG. 15 is a drawing to show the relationship between three ink droplets, which are ejected based on the waveform pattern A and the waveform pattern B, and a dot, which is formed by the three ink droplets. The direction from the bottom to the top of the plane of the figure is the print paper transport direction. FIG. 16 is a drawing to show the print result when the successive selection inhibition count n is set to two. As shown in FIG. 15, in the waveform pattern A, three ink droplets I ejected according to three normal pulses form one dot J in a state in which the ink droplets are arranged along the print paper transport direction. In the waveform pattern B, two ink droplets I ejected according to two normal pulses are arranged along the print paper transport direction and further one ink droplet I' ejected according to one deformation pulse is placed at a position that is displaced from the positions of the ink droplets I with respect to the direction orthogonal to the print paper transport direction, so that the two ink droplets I and the one ink droplet I' forms one dot J'. If ink droplets are ejected based on the waveform pattern A and the waveform pattern B from the same nozzle 8, the formed dots J and J' are separated from each other in the direction orthogonal to the print paper transport direction as shown by dot and dashed lines A and B in FIG. 15.

If print is executed with the successive selection inhibition count n set to two, the dots J and J' are placed in a staggered arrangement while the center positions of the dots J and J' are located at different positions from each other with respect to the direction orthogonal to the print paper transport direction, as shown in FIG. 16. Moreover, a position of a center of a dot formed on the print paper by the nozzle according to the waveform pattern A and a position of a center of a dot formed on the print paper by the same nozzle according to the waveform pattern B are separated from each other. As for the nozzle row, the waveform pattern is selected so that the nozzles 8 in the same nozzle row eject the ink droplets based on the same waveform pattern. Thus, the same dots J or J' are arranged in the row in the direction orthogonal to the print paper transport direction.

According to the embodiment described above, the dots J or J' are not formed on print paper successive times more than or equal to the successive selection inhibition count n, along the print paper transport direction. Thus, if high-density print is executed, occurrence of a white stripe can be restricted in the print result. At this time, the successive selection inhibition count n is set to 100 or less, so that a white stripe can be efficiently made inconspicuous in the print result. Further, the successive selection inhibition count n is set to two, whereby a white stripe can be made most inconspicuous in the print result.

As for the nozzle row, the waveform pattern is selected so that the nozzles 8 in the same nozzle eject the ink droplets based on the sate waveform pattern, so that the different dots J and J' are not mixedly arranged in the same row in the direction orthogonal to the print paper transport direction, and a white patch or friar can be prevented from occurring in the print result.

Further, the waveform information storage section 144 stores only two types of information of the waveform pattern A and the waveform pattern B for each gradation level with respect to each nozzle 8, so that the storage amount of the waveform information storage section 144 can be restricted. Moreover, a position of a center of a dot formed on the print paper by the nozzle according to the waveform pattern A and a position of a center of a dot formed on the print paper by the same nozzle according to the waveform pattern B are separated from each other in the direction orthogonal to the printer paper transport direction, so that the two dots J, J' can be effectively separated from each other and occurrence of a white stripe can be furthermore restricted in the print result.

In the waveform pattern B, a deformation pulse is used for the pulse for ejecting the last ink droplet only, so that the ink droplet ejection characteristic is hardly degraded as a whole. In particular, the ink droplet ejection timing in the deformation pulse is the same as the ink droplet ejection timing in the normal pulse, so that furthermore the ink droplet ejection characteristic is hardly degraded.

In addition, the waveform pattern A and the waveform pattern B are given a cancel pulse to remove the residual pressure, so that the ink droplet ejection characteristic is further hardly degraded.

Since the shape of the individual ink flow passages 32 viewed from the ink ejection face is not symmetrical with respect to the center line of the pressure chamber 10 along the paper transport direction, the meniscus distortion becomes large and the dots J and J' can be formed at more distant positions in the direction orthogonal to the print paper transport direction. Accordingly, occurrence of a white stripe can be more efficiently restricted in the print result.

Figure 17:
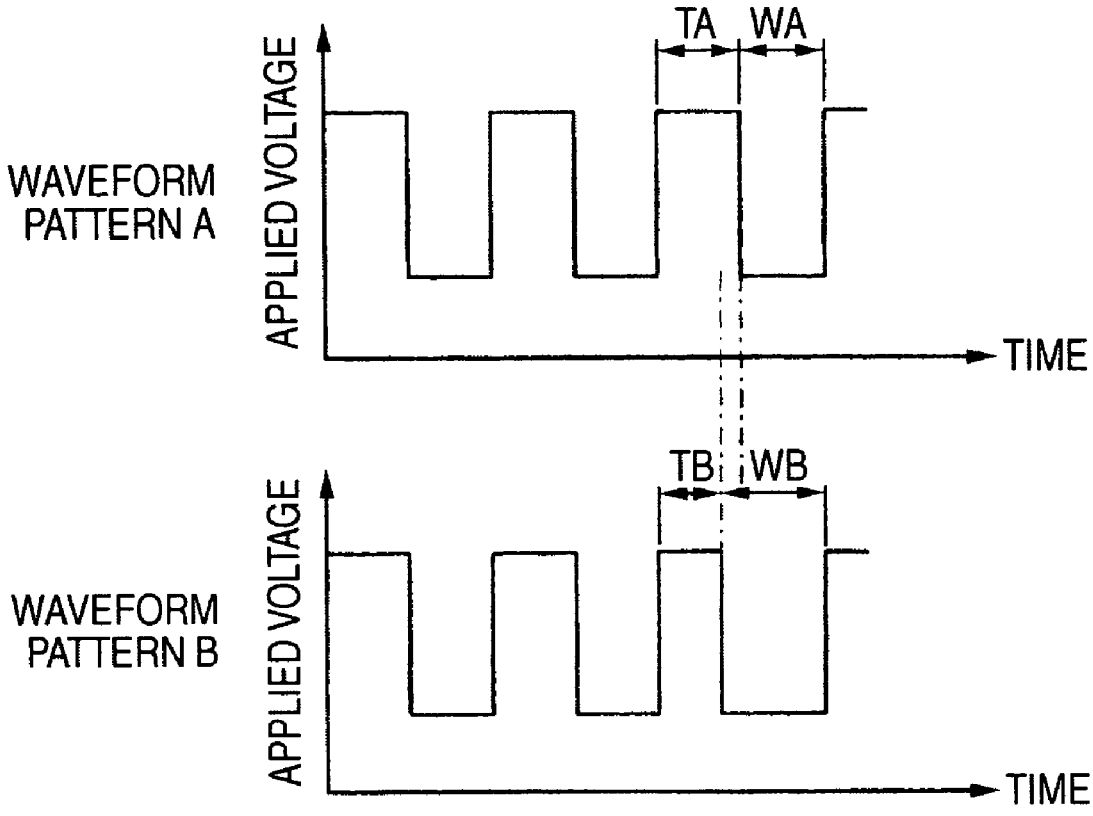
FIG. 17 shows modification examples of the waveform patterns stored in the waveform information storage section shown in FIG. 10.

In the embodiment described above, the residual pressure is removed by using the waveform pattern A and the waveform pattern B given a cancel pulse, but the invention is not limited to the mode. As shown in FIG. 17, the waveform pattern A and the waveform pattern B given no cancel pulse may be used. According to this mode, the residual pressure wave with a phase lead exists until it naturally decays, still after ink droplet I' is ejected based on the waveform pattern B. Therefore, the residual pressure wave also exerts an influence upon the ejection of the ink droplet for forming a next successive dot, so that a phase lead of the pressure wave generated according to a normal pulse occurs. Thus, an ink droplet is ejected in a state in which the meniscus is distorted also when a normal pulse is applied, and the ejected ink droplet hits a position deflected in the direction orthogonal to the print paper transport direction. If the residual pressure wave decays, the amount of the phase lead of the pressure wave generated according to the normal pulse is reduced and thus the deflection amount of the ink droplet hit position is also reduced.

In this case, after the waveform pattern B is selected and ink droplets are ejected, considering the effect time of the residual pressure wave, the waveform selection section 146 continues to select the waveform pattern A, assuming that the waveform pattern B is successive while the position of the dot formed based on the waveform pattern A is substantially the same as the position of the dot formed based on the waveform pattern B. Also in this case, the position of the dot to be formed based on the waveform pattern A is displaced with the passage of time and therefore strictly differs from the position of the dot to be formed based on the waveform pattern B.

Figure 18:
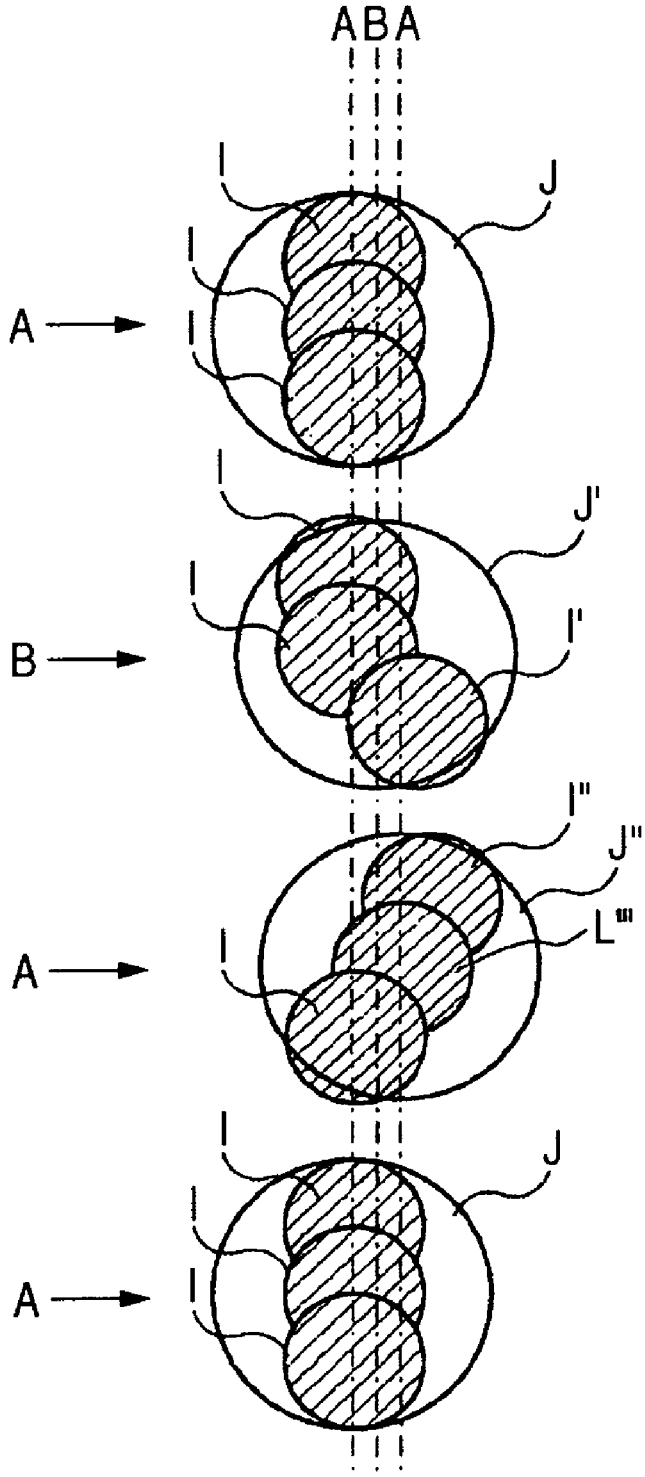
FIG. 18 is a drawing to show ink droplets ejected based on the waveform patterns shown in FIG. 10 and dots formed by the ink droplets.

The print result obtained under the conditions described above will be discussed with reference to FIG. 18. FIG. 18 is a drawing to show the relationship between three ink droplets ejected based on the waveform pattern A and the waveform a pattern B shown in FIG. 17 and each dot formed on print paper by the three ink droplets. The successive selection inhibition count n is set to two. As shown in FIG. 18, if ink droplets are ejected according to normal pulses based on the waveform pattern A after a dot J' is formed based on the waveform pattern B, the ink droplets I", I'", I hit the print paper at positions where the displacement in the direction orthogonal to the print paper transport direction is reduced in the order of ink droplets I", I'", and I because of the effect of the residual pressure generated by the deformation pulse of the waveform pattern B. These ink droplets I", I'", I form a dot J". The dot J' is displaced in the direction orthogonal to the print paper transport direction with respect to the dot J that is formed based on the waveform pattern A as shown by dot and dashed lines A and B. The displacement amount of the dot J" is substantially equal to that of the dot J' formed based on the waveform pattern S. Therefore, ink droplets are then ejected based on the waveform pattern A. As shown by the dot and dashed lines A and B, the positions of the center of the dots J, J', J" are separated from each other in the direction orthogonal to the print paper transport direction.

Accordingly, if a cancel pulse cannot be given or the effect of the residual pressure cannot be avoided because the ejection period is shortened, the dot position can also be displaced for restricting occurrence of a white stripe in the print result.

Although the invention has been described in the embodiment, it is to be understood that the invention is not limited to the specific embodiment and that various design changes can be made within the spirit and scope as set out in the claims. For example, in the embodiment, the ejection history storage section 145 is included, but the invention is not limited to the configuration. A waveform pattern selection pattern may be predetermined and the waveform pattern to be used may be changed in accordance with the predetermined waveform pattern selection pattern, irrespective of the ejection history.

In the embodiment, the waveform selection section 146 selects the waveform pattern to be used from the waveform pattern A and the waveform pattern B, but the invention is not limited to the mode. Three or more types of waveform patterns may be stored in the waveform information storage section 144 and the waveform selection section 146 may select the waveform pattern to be used from among the stored waveform patterns.

Further, in the embodiment, the same waveform pattern is selected for each nozzle row, but the invention is not limited to the mode. Any desired waveform pattern may be selected for each nozzle 8.

In addition, in the embodiment, only the last pulse for ejecting an ink droplet in the waveform pattern B is a deformation pulse, but the invention is not limited to the mode. At least one of the pulses may be a deformation pulse. For example, all pulses each for ejecting an ink droplet may be deformation pulses or only the first pulse for ejecting an ink droplet may be a deformation pulse.

Further, in the embodiment, the ink jet printer 101 is a line printer, but the invention is not limited to the mode. The ink jet printer 101 may be a serial printer.

According to the embodiments of the invention, there is provided an ink jet record apparatus including an ink jet head for ejecting ink droplets from a plurality of nozzles; a drive mechanism that causes relative movement between a print medium and the ink jet head; and the controller of the ink jet head described above.

According to the embodiments of the invention, preferably the controller further includes an ejection history storage member for storing ejection history information as to which of the plurality of types of drive signals relating to the waveform information stored in the waveform information storage member has been selected by the selection member, with respect to N dots most recently formed on the print medium (where N is a natural number), wherein the selection member does not select the same type of drive signal n or more successive times (where n is a natural number ranging from 2 to N+1) for each nozzle based on the ejection history information stored in the ejection history storage member. Accordingly, the position of one dot can be selected based on the position of another dot, so that occurrence of a white stripe can be reliably restricted in the print result.

According to the embodiments of the invention, preferably, n is 100 or less, whereby a white stripe can be efficiently made inconspicuous in the print result. Further, more preferably n is 2, whereby a white stripe can be made most inconspicuous in the print result.

According to the embodiments of the invention, preferably the selection member selects a same type of drive signal for each nozzle row including the nozzles arranged adjacently in the predetermined direction. Accordingly, a white patch, which is produced in the print result as the dots adjacent to each other in the direction orthogonal to the relative move direction of the print medium to the ink jet head shift in the opposite directions can be prevented.

According to another aspect of the invention, preferably the waveform information storage member stores the waveform information concerning two types of drive signals. A first line connecting a center of a dot corresponding to the one type of drive signals is arranged in the predetermined direction on the print medium A second line connecting a center of a dot corresponding to the other type of drive signals is arranged in the predetermined direction on the print medium. Accordingly, the waveform information concerning the two types of drive signals is only stored, so that the amount of the information to be stored in the waveform information storage member can be restricted. Both the first and second lines connecting the center of the dots are respectively arranged in the direction orthogonal to the printer paper transport direction and thus, the occurrence of a white stripe can be further restricted in the print result.

According to the embodiments of the invention, preferably the waveform information storage member stores the waveform information concerning the plurality of types of drive signals for each of a plurality of different types of ink ejection amounts corresponding to one dot on the print medium. Accordingly, occurrence of a white stripe can be restricted in the print result when gradation is represented.

According to the embodiments of the invention, preferably the waveform information storage member stores the waveform information concerning a first drive signal for causing a plurality of ink droplets ejected successively from the nozzle to form one dot on the print medium and making the ejection directions of the plurality of ink droplets the same for each of the plurality types of ink ejection amounts and a second drive signal for making only the ejection direction of some of the plurality of ink droplets different from the ejection direction of other ink droplets and forming a dot at a different position from the position of the dot formed on the print medium based on the first drive signal with respect to the predetermined direction. Accordingly, the dot size can be simply changed by changing the number of ink droplets to be ejected, so that gradation can be easily represented. Since the ejection timings of only some ink droplets are changed, the ink ejection characteristic is hardly degraded as a whole.

According to the embodiments of the invention, preferably the waveform information storage member stores the waveform information concerning the first drive signal for causing a plurality of ink droplets ejected successively from the nozzle to form one dot on the print medium and making the ejection directions of the plurality of ink droplets the same for each of the plurality types of ink ejection amounts and the second drive signal for making only the ejection direction of the ink droplet of the plurality of ink droplets last ejected from the nozzle different from the ejection direction of other ink droplets and forming a dot at a different position from the position of the dot formed on the print medium based on the first drive signal with respect to the predetermined direction. Accordingly, the dot size can be simply changed by changing the number of ink droplets to be ejected, so that the gradation can be easily represented. Since the ejection timing of only the last ejected ink droplet is changed, the ink ejection characteristic is further hardly degraded.

According to the embodiments of the invention, preferably, when the selection member successively attempts to selects the first drive signal just after a dot is formed on the print medium based on the second drive signal for the nozzle, if a first one of a plurality of dots to be formed on the print medium based on the successively selected first drive signals to be displaced by an amount that is substantially the same as the a displacement amount of the dots formed on the print medium based on the second drive signal, with respect to the predetermined direction, the selection member is allowed to select the first drive signal at least two successive tines. Accordingly, if the position of a dot, which is formed just after a dot was formed based on the second drive signal, is affected by the second drive signal, occurrence of a white stripe can be restricted in the print result.

According to the embodiments of the invention, when the selection member successively selects the first drive signal just after a dot is formed on the print medium based on the second drive signal for the nozzle, if all of a plurality of the dots to be formed on the print medium based on the successively selected first drive signals to be displaced by an amount that is substantially the same as the displacement amount of the dots formed on the print medium based on the second drive signal, with respect to the predetermined direction, the selection member selects a third drive signal having a signal for restoring the position of a dot to be formed to the original position added following the first drive signal after selecting the second drive signal or after selecting one or more first drive signals further after selecting the second drive signal. Accordingly, if the position of a dot, which is formed after a dot was formed based on the second drive signal, is affected by the second drive signal, the effect of the second drive signal is eliminated by the third drive signal and thus occurrence of a white stripe can be restricted in the print result.

According to the embodiments of the invention, the ink jet head may extend in the predetermined direction so as to cross the print medium and may include one or more nozzle rows each made up of a plurality of nozzles arranged adjacently in the predetermined direction. At this time, preferably the nozzles belonging to the ink jet head may be placed so that the nozzles are equally spaced from each other in the predetermined direction and differ from each other in the predetermined direction. Accordingly, in a line printer, occurrence of a white stripe can be efficiently restricted in the print result.

According to the embodiments of the invention, preferably, the ink jet head includes a flow passage unit wherein a plurality of individual ink flow passages are placed each containing the nozzle, a pressure chamber communicating with the nozzle, and an aperture communicating with the pressure chamber; and an actuator unit including a plurality of individual electrodes placed at positions opposed to the pressure chambers, to which the drive signal is input, a common electrode to which a ground potential is supplied, and a piezoelectric sheet sandwiched between the common electrode and the plurality of individual electrodes, the actuator unit being joined to one surface of the flow passage unit for changing the volume of the pressure chamber, wherein the flat shape of the individual ink flow passages viewed from the direction orthogonal to the ink ejection face of the ink jet head is not symmetrical with respect to the center line of the pressure chamber. Accordingly, the propagation timings of the pressure in the individual ink flow passages become nonuniform and the ink ejection directions are easy to vary, so that the displacement amount between the dots formed by different types of drive signals is increased and occurrence of a white stripe can be efficiently restricted in the print result.

According to the embodiments of the invention, preferably, a different type of drive signal differs from another type of drive signal in at least a part of the timing for generating a pressure in the pressure chamber on the vibration period of an ink meniscus formed on the nozzle. Accordingly, the displacement amount between the dots formed by different types of drive signals on the print medium can be more increased.

According to the embodiments of the invention, preferably, the drive signal contains a plurality of pulses each containing a falling edge for generating a negative pressure in the pressure chamber and a rising edge for generating a positive pressure in the pressure chamber, and a different type of drive signal differs from another type of drive signal only in the timing of the falling edge. Accordingly, the ink ejection timing is not different among the different type of drive signals, so that the ink ejection characteristic can be stabilized.

What is claimed is:

1. A controller of an ink jet head for ejecting ink droplets from a plurality of nozzles, comprising:

a waveform information storage member that stores waveform information concerning a plurality of types of drive signals capable of displacing positions of dots to be formed on a print medium by ejecting ink from the nozzles different from each other with respect to a predetermined direction orthogonal to a relative moving direction between the print medium and the ink jet head; and a selection member that selects one drive signal from among the plurality of types of drive signals relating to the waveform information stored in the waveform information storage member so that a same type of drive signal is not selected n or more successive times (where n is a natural number of 2 or more) for each nozzle.

2. The controller of the ink jet head according to claim 1, further comprising:

an ejection history storage member that stores ejection history information as to which of the plurality of types of drive signals relating to the waveform information stored in the waveform information storage member has been selected by the selection member, with respect to N dots most recently formed on the print medium (where N is a natural number), wherein the selection member does not select the same type of drive signal n or more successive times (where n is a natural number ranging from 2 to N+1) for each nozzle based on the ejection history information stored in the ejection history storage member.

3. The controller of the ink jet head according to claim 1, wherein n is 100 or less.

4. The controller of the ink jet head according to claim 1, wherein n is 2.

5. The controller of the ink jet head according to claim 1, wherein the selection member selects a same type of drive signal for each nozzle row including the nozzles which are arranged adjacently in the predetermined direction.

6. The controller of the ink jet head according to claim 1, wherein the waveform information storage member stores the waveform information concerning two types of drive signals, wherein a position of a dot formed on the print medium by ink ejection from the nozzle according to one of the two types of drive signals and a position of a dot formed on the print medium by ink ejection from the nozzle according to another of the two types of drive signals are separated from each other in the predetermined direction.

7. The controller of the ink jet head according to claim 1, wherein the waveform information storage member stores the waveform information concerning the plurality of types of drive signals for each of a plurality of different types of ink ejection amounts corresponding to one dot on the print medium.

8. The controller of the ink jet head according to claim 7, wherein the drive signals including a first drive signal and a second drive signal cause a plurality of ink droplets ejected successively from the nozzle to form one dot on the print medium, and wherein the waveform information storage member stores the waveform information concerning the first drive signal for making the ejection directions of the plurality of ink droplets the same for each of the plurality types of ink ejection amounts and the second drive signal for making the ejection direction of only some of the plurality of ink droplets different from the ejection direction of other ink droplets and forming a dot at a different position from the position of the dot formed on the print medium based on the first drive signal with respect to the predetermined direction.

9. The controller of the ink jet head according to claim 7, wherein the signals including a first drive signal and a second drive signal cause a plurality of ink droplets ejected successively from the nozzle to form one dot on the print medium, and wherein the waveform information storage member stores the waveform information concerning the first drive signal for making the ejection directions of the plurality of ink droplets the same for each of the plurality types of ink ejection amounts and the second drive signal for making only the ejection direction of the ink droplet of the plurality of ink droplets last ejected from the nozzle different from the ejection direction of other ink droplets and forming a dot at a different position from the position of the dot formed on the print medium based on the first drive signal with respect to the predetermined direction.

10. The controller of the ink jet head according to claim 9, wherein when the selection member attempts to successively select the first drive signal just after a dot is formed on the print medium based on the second drive signal for the nozzle, if a first one of a plurality of dots to be formed on the print medium based on the successively selected first drive signals is to be displaced by an amount that is substantially the same as a displacement amount of the dot formed on the print medium based on the second drive signal, with respect to the predetermined direction, the selection member is allowed to select the first drive signal at least two successive tines.

11. The controller of the ink jet head according to claim 9, wherein when the selection member successively selects the first drive signal just after a dot is formed on the print medium based on the second drive signal for the nozzle, if all of a plurality of dots to be formed on the print medium based on the successively selected first drive signals are to be displaced by an amount that is substantially the same as a displacement amount of the dot formed on the print medium based on the second drive signal, with respect to the predetermined direction, the selection member selects a drive signal having different from a preceding drive signal after selecting the second drive signal or after selecting one or more first drive signals after the second drive signal.

12. The controller of the ink jet head according to claim 1, wherein the plurality of types of drive signals are configured to position centers of the dots at different locations.

13. A control method of an ink jet head for ejecting ink droplets from a plurality of nozzles, comprising:

selecting one drive signal from among a plurality of types of drive signals capable of displacing positions of dots to be formed on a print medium by ejecting ink from the nozzles different from each other with respect to a predetermined direction orthogonal to a relative moving direction between the print medium and the ink jet head so that the same type of drive signal is not selected n or more successive times (where n is a natural number of 2 or more) for each nozzle.

14. An ink jet record apparatus comprising:

an ink jet head that ejects ink droplets from a plurality of nozzles;

a drive mechanism that causes relative movement between a print medium and the ink jet head; and the controller according claim 1.

15. The ink jet record apparatus according to claim 14, wherein the ink jet head extends in the predetermined direction so as to cross the print medium, and wherein the ink jet head includes one or more nozzle rows each having the plurality of nozzles which are arranged adjacently in the predetermined direction.

16. The ink jet record apparatus according to claim 15, wherein the nozzles belonging to the ink jet head are placed so that the nozzles are equally spaced from each other in the predetermined direction and are displaced from each other in the predetermined direction.

17. The ink jet record apparatus according to claim 14, wherein the ink jet head includes:

a flow passage unit having;

a plurality of individual ink flow passages each including one of the plurality of nozzles;

a pressure chamber communicating with the nozzle; and an aperture communicating with the pressure chamber; and an actuator unit joined to one surface of the flow passage unit for changing the volume of the pressure chambers, the actuator unit having;

a plurality of individual electrodes opposed to each of the respective pressure chambers and to which the drive signal is input;

a common electrode to which a ground potential is supplied; and a piezoelectric sheet sandwiched between the common electrode and the plurality of individual electrodes, wherein the planar shape of each of individual ink flow passages viewed from the direction orthogonal to an ink ejection face of the ink jet head is not symmetrical with respect to a center line of each of the pressure chambers.

18. The ink jet record apparatus according to claim 17, wherein at least one of times at which a pressure is generated in the pressure chamber is different among the plurality of types of the drive signals in a vibration period of an ink meniscus formed at the nozzle.

19. The ink jet record apparatus according to claim 18, wherein each of the plurality of types of the drive signals includes a plurality of pulses each having a falling edge for generating a negative pressure in the pressure chamber and a rising edge for generating a positive pressure in the pressure chamber, and wherein a fall time of at least one of the plurality of pulses is different among the plurality of types of the drive signals.

20. The control method according to claim 13, wherein the plurality of types of drive signals are configured to position centers of the dots at different locations.

21. A controller of an ink jet head for ejecting ink droplets from a plurality of nozzles, comprising:

a waveform information storage member that stores waveform information concerning a plurality of types of drive signals capable of displacing positions of dots formed on a print medium by ejecting ink from the nozzles different from each other with respect to a predetermined direction orthogonal to a relative move direction of the print medium to the ink jet head; and a selection member that selects one drive signal from among the plurality of types of drive signals relating to the waveform information stored in the waveform information storage member, wherein when a same type of the drive signal is selected "n−1" successive times (where n is a natural number of 2 or more) for each nozzle, the selection member selects from among the plurality of types of drive signals relating to the wave form information a drive signal which is different from the successively selected same type of the drive signal.

22. The controller according to claim 21, wherein the plurality of types of drive signals are configured to position centers of the dots at different locations.

* * * * *